US006645706B1

(12) United States Patent
Simpson et al.

(10) Patent No.: US 6,645,706 B1
(45) Date of Patent: Nov. 11, 2003

(54) THERMALLY DEVELOPABLE MATERIALS WITH IMPROVED SPEED AND CONTRAST AND METHODS OF USE

(75) Inventors: Sharon M. Simpson, Lake Elmo, MN (US); Takuzo Ishida, Woodbury, MN (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/245,265

(22) Filed: Sep. 17, 2002

(51) Int. Cl.[7] ..... G03C 1/498; G03C 5/16

(52) U.S. Cl. ..... 430/350; 430/510; 430/523; 430/531; 430/619; 430/620; 430/959; 430/964; 430/139; 503/201; 503/216

(58) Field of Search ..... 430/619, 523, 430/350, 531, 139, 964, 959, 620, 510; 503/201, 216

(56) References Cited

U.S. PATENT DOCUMENTS

| | | | | |
|---|---|---|---|---|
| 3,761,720 A | | 9/1973 | de Mauriac et al. | |
| 4,426,441 A | | 1/1984 | Adin et al. | |
| 4,789,623 A | * | 12/1988 | Sato et al. | 430/351 |
| 5,536,622 A | | 7/1996 | Simpson et al. | |
| 5,545,505 A | | 8/1996 | Simpson | |
| 5,545,507 A | | 8/1996 | Simpson et al. | |
| 5,558,983 A | | 9/1996 | Simpson et al. | |
| 6,063,559 A | * | 5/2000 | Uyttendaele et al. | 430/617 |
| 6,358,677 B1 | | 3/2002 | Taniguchi et al. | |

FOREIGN PATENT DOCUMENTS

| | | |
|---|---|---|
| EP | 1 168 071 A2 | 1/2002 |
| WO | WO 97/11409 | 3/1997 |
| WO | WO 01/96949 A1 | 12/2001 |

* cited by examiner

*Primary Examiner*—Thorl Chea
(74) *Attorney, Agent, or Firm*—J. Lanny Tucker; Louis M. Leichter

(57) ABSTRACT

Thermally developable materials include a reducing agent composition that can reduce silver ions and provide high contrast images. The reducing agent composition includes a) a hindered phenol reducing agent, an aromatic di- or tri-hydroxy compound, or mixtures thereof, and b) a thermally-releasable p-phenylenediamine co-developer that is represented by the following Structure I:

R—NH-BLOCK (I)

wherein R—NH— is a p-phenylenediamine group and BLOCK is a blocking group that is cleaved upon exposure to at least 120° C. for at least 5 seconds and comprises one or more of the following thermally cleavable groups: —CONH—, —COO—, —$CONHSO_2$—, —$PO_3$—, —$SO_2$—, —$COCH_2NHCO$—, or —COS—, and BLOCK is directly linked to R—NH— through one of the thermally cleavable groups.

22 Claims, No Drawings

THERMALLY DEVELOPABLE MATERIALS WITH IMPROVED SPEED AND CONTRAST AND METHODS OF USE

FIELD OF THE INVENTION

This invention relates to thermally developable imaging materials having improved speed and contrast. In particular it relates to thermographic and photothermographic materials containing specific co-developers combined with hindered phenol reducing agents, aromatic di- or tri-hydroxy compounds, or mixtures thereof. The invention also relates to methods of imaging these materials.

BACKGROUND OF THE INVENTION

Silver-containing thermographic and photothermographic imaging materials (that is, thermally developable imaging materials) that are imaged and/or developed using heat and without liquid processing have been known in the art for many years.

Silver-containing thermographic imaging materials are non-photosensitive materials that are used in a recording process wherein images are generated by the use of thermal energy. These materials generally comprise a support having disposed thereon (a) a relatively or completely non-photosensitive source of reducible silver ions, (b) a reducing composition (usually including a developer) for the reducible silver ions, and (c) a suitable hydrophilic or hydrophobic binder.

In a typical thermographic construction, the image-forming layers are based on silver salts of long chain fatty acids. Typically, the preferred non-photosensitive reducible silver source is a silver salt of a long chain aliphatic carboxylic acid having from 10 to 30 carbon atoms. The silver salt of behenic acid or mixtures of acids of similar molecular weight are generally used. At elevated temperatures, the silver of the silver carboxylate is reduced by a reducing agent for silver ion such as methyl gallate, hydroquinone, substituted-hydroquinones, hindered phenols, catechols, pyrogallol, ascorbic acid, and ascorbic acid derivatives, whereby an image of elemental silver is formed. Some thermographic constructions are imaged by contacting them with the thermal head of a thermographic recording apparatus such as a thermal printer or thermal facsimile. In such constructions, an anti-stick layer is coated on top of the imaging layer to prevent sticking of the thermographic construction to the thermal head of the apparatus utilized. The resulting thermographic construction is then heated to an elevated temperature, typically in the range of from about 60 to about 225° C., resulting in the formation of an image.

Silver-containing photothermographic imaging materials are photosensitive materials that are used in a recording process wherein an image is formed by imagewise exposure of the photothermographic material to specific electromagnetic radiation (for example, X-radiation, or ultraviolet, visible, or infrared radiation) and developed by the use of thermal energy. These materials, also known as "dry silver" materials, generally comprise a support having coated thereon: (a) a photocatalyst (that is, a photosensitive compound such as silver halide) that upon such exposure provides a latent image in exposed grains that are capable of acting as a catalyst for the subsequent formation of a silver image in a development step, (b) a relatively or completely non-photosensitive source of reducible silver ions, (c) a reducing composition (usually including a developer) for the reducible silver ions, and (d) a hydrophilic or hydrophobic binder. The latent image is then developed by application of thermal energy.

In such materials, the photosensitive catalyst is generally a photographic type photosensitive silver halide that is considered to be in catalytic proximity to the non-photosensitive source of reducible silver ions. Catalytic proximity requires intimate physical association of these two components either prior to or during the thermal image development process so that when silver atoms $(Ag^0)_n$, also known as silver specks, clusters, nuclei or latent image, are generated by irradiation or light exposure of the photosensitive silver halide, those silver atoms are able to catalyze the reduction of the reducible silver ions within a catalytic sphere of influence around the silver atoms [D. H. Klosterboer, *Imaging Processes and Materials*, (*Neblette's Eighth Edition*), J. Sturge, V. Walworth, and A. Shepp, Eds., Van Nostrand-Reinhold, New York, 1989, Chapter 9, pp. 279–291]. It has long been understood that silver atoms act as a catalyst for the reduction of silver ions, and that the photosensitive silver halide can be placed in catalytic proximity with the non-photosensitive source of reducible silver ions in a number of different ways (see, for example, *Research Disclosure*, June 1978, item 17029). Other photosensitive materials, such as titanium dioxide, cadmium sulfide, and zinc oxide have also been reported to be useful in place of silver halide as the photocatalyst in photothermographic materials [see for example, Shepard, *J. Appl. Photog. Eng.* 1982, 8(5), 210–212, Shigeo et al., Nippon Kagaku Kaishi, 1994, 11, 992–997, and FR 2,254,047 (Robillard)].

The photosensitive silver halide may be made "in-situ," for example by mixing an organic or inorganic halide-containing source with a source of reducible silver ions to achieve partial metathesis and thus causing the in-situ formation of silver halide (AgX) grains throughout the silver source [see, for example, U.S. Pat. No. 3,457,075 (Morgan et al.)]. In addition, photosensitive silver halides and sources of reducible silver ions can be coprecipitated [see Yu. E. Usanov et al., *J. Imag. Sci. Tech.* 1996, 40, 104]. Alternatively, a portion of the reducible silver ions can be completely converted to silver halide, and that portion can be added back to the source of reducible silver ions (see Yu. E. Usanov et al., International Conference on Imaging Science, Sep. 7–11, 1998, pp. 67–70).

The silver halide may also be "preformed" and prepared by an "ex-situ" process whereby the silver halide (AgX) grains are prepared and grown separately. With this technique, one has the possibility of controlling the grain size, grain size distribution, dopant levels, and composition much more precisely, so that one can impart more specific properties to both the silver halide grains and the photothermographic material. The preformed silver halide grains may be introduced prior to and be present during the formation of the source of reducible silver ions. Co-precipitation of the silver halide and the source of reducible silver ions provides a more intimate mixture of the two materials [see for example U.S. Pat. No. 3,839,049 (Simons)]. Alternatively, the preformed silver halide grains may be added to and physically mixed with the source of reducible silver ions.

The non-photosensitive source of reducible silver ions is a material that contains reducible silver ions. Typically, the preferred non-photosensitive source of reducible silver ions is a silver salt of a long chain aliphatic carboxylic acid having from 10 to 30 carbon atoms, or mixtures of such salts. Such acids are also known as "fatty acids" or "fatty carboxylic acids." Silver salts of other organic acids or other organic compounds, such as silver imidazoles, silver tetrazoles, silver benzotriazoles, silver benzotetrazoles, silver benzothiazoles and silver acetylides may also be used. U.S. Pat. No. 4,260,677 (Winslow et al.) discloses the use of complexes of various inorganic or organic silver salts.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer(s).

Differences Between Photothermography and Photography

The imaging arts have long recognized that the field of photothermography is clearly distinct from that of photography. Photothermographic materials differ significantly from conventional silver halide photographic materials that require processing with aqueous processing solutions.

As noted above, in photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example a silver carboxylate) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself at least partially converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. Even in so-called "instant photography," the developer chemistry is physically separated from the photosensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems during the preparation of the photothermographic emulsion as well as during coating, use, storage, and post-processing handling.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

In photothermographic materials, the binder is capable of wide variation and a number of binders (both hydrophilic and hydrophobic) are useful. In contrast, conventional photographic materials are limited almost exclusively to hydrophilic colloidal binders such as gelatin.

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Imaging Processes and Materials* (*Neblette's Eighth Edition*), noted above, *Unconventional Imaging Processes*, E. Brinckman et al. (Eds.), The Focal Press, London and New York, 1978, pp. 74–75, in Zou et al., *J. Imaging Sci. Technol.* 1996, 40, pp. 94–103, and in M. R. V. Sahyun, *J. Imaging Sci. Technol.* 1998, 42, 23.

Problem to be Solved

One of the efforts directed to improvements in "dry" imaging materials including both thermographic and photothermographic materials, is to find a means to increase the speed and contrast of resulting images to those obtained using wet-processed photographic materials. In particular, there is a desire to provide "high contrast" images (that is, contrast values over 8). To achieve this result, a number of reducing agent systems have been found that include one or more developing agents (that is, silver ion reducing agents) used with or without what are known as "co-developers" and/or "high contrast agents." Some of these reducing agent systems are described, for example, in U.S. Pat. No. 5,536,622 (Simpson et al.), U.S. Pat. No. 5,545,505 (Simpson), U.S. Pat. No. 5,545,507 (Simpson et al.), U.S. Pat. No. 5,545,515 (Murray et al.), and U.S. Pat. No. 5,558,983 (Simpson et al.). U.S. Pat. No. 6,358,677 (Taniguchi et al.) describes the use of blocked aminophenol compounds to thermally release aminophenol co-developers in heat-developable recording materials.

As other components of the thermographic and photothermographic materials are changed, however, there is often a need to find additional reducing agent compositions that maintain or improve image contrast. In particular, there is often a need for a means to maintain or improve image contrast when the photothermographic materials are modified with different or additional chemical sensitizers or by an increase in photosensitive silver halide grain size. Known reducing agent compositions and combinations may not always provide the desired image contrast in such embodiments. It is to this problem that the present invention is addressed.

SUMMARY OF THE INVENTION

This invention provides a black-and-white thermally developable material that comprises a support having thereon one or more thermally developable imaging layers comprising:

a binder, a non-photosensitive source of reducible silver ions, and a reducing agent composition for the non-photosensitive source reducible silver ions, the reducing agent composition comprising: a) a hindered phenol reducing agent, an aromatic di- or tri-hydroxy compound, or mixtures thereof, and b) a thermally-releasable p-phenylenediamine co-developer that is represented by the following Structure I:

R—NH-BLOCK (I)

wherein R—NH— is a p-phenylenediamine group and BLOCK is a blocking group that is cleaved upon exposure to at least 120° C. for at least 5 seconds and comprises one or more of the following thermally cleavable groups: —CONH—, —COO—, —$CONHSO_2$—, —$PO_3$—, —$SO_2$—, —$COCH_2NHCO$—, or —COS—, and BLOCK is directly linked to R—NH— through one of the thermally cleavable groups.

Such thermally developable materials can be either thermographic or photothermographic materials.

This invention also provides a method for providing a black-and-white image comprising thermally forming and developing a visible image in the thermally developable thermographic material of the present invention.

In preferred embodiments, the thermally developable materials of the present invention are photothermographic materials that further comprise a photosensitive silver halide in reactive association with the non-photosensitive source of reducible silver ions and the reducing agent composition.

Such black-and-white photothermographic materials particularly comprise a support having thereon one or more thermally developable imaging layers comprising:

a binder, a photosensitive silver halide, a non-photosensitive source of reducible silver ions, and a reducing agent composition for the non-photosensitive source reducible silver ions, the reducing agent composition comprising a) a hindered phenol reducing agent, and b) a thermally-releasable p-phenylenediamine co-developer that is represented by Structure I noted above.

Further still, the present invention provides an imaging assembly comprising a photothermographic material arranged in association with a phosphor intensifying screen, the photothermographic material comprising a support having thereon one or more thermally developable imaging layers comprising:

a binder, a photosensitive silver halide, a non-photosensitive source of reducible silver ions, and a reducing agent composition for the non-photosensitive source of reducible silver ions, the reducing agent composition comprising: a) a hindered phenol reducing agent, and b) a thermally-releasable p-phenylenediamine co-developer that is represented by the following Structure I:

R—NH-BLOCK (I)

wherein R—NH— is a p-phenylenediamine group and BLOCK is a blocking group that is cleaved upon exposure to at least 120° C. for at least 5 seconds and comprises one or more of the following thermally cleavable groups: —CONH—, —COO—, —$CONHSO_2$—, —$PO_3$—, —$SO_2$—, —$COCH_2NHCO$—, or —COS—, and BLOCK is directly linked to R—NH— through one of the thermally cleavable groups.

This invention also provides a method for providing a black-and-white image comprising thermally forming and developing an image in the thermally developable photothermographic material described above.

Further still, this invention provides a method of forming a visible image comprising:

A) imagewise exposing the photothermographic material of this invention to electromagnetic radiation to which the photocatalyst (for example, a photosensitive silver halide) of the material is sensitive to form a latent image, and B) simultaneously or sequentially, heating the exposed photothermographic material to develop the latent image into a visible image.

The present invention provides black-and-white images with desired contrast in high-speed thermally developable materials even when other components are present that would normally lower image contrast. This advantage is achieved with the use of a combination of a hindered phenol reducing agent, an aromatic di- or tri-hydroxy compound, or mixtures thereof, and a specific thermally-releasable p-phenylenediamine co-developer in the imaging layers.

The present invention also improves the speed, density, and contrast of black-and-white thermally developable materials with only minimal effects on $D_{min}$.

DETAILED DESCRIPTION OF THE INVENTION

The thermally developable materials of this invention include both thermographic and photothermographic materials. While the following discussion will often be directed primarily to the preferred photothermographic embodiments, it would be readily understood by one skilled in the imaging arts that thermographic materials can be similarly constructed (using one or more imaging layers) and used to provide black-and-white or color images using non-photosensitive silver salts, reducing compositions, binders, and other components known to be used in such embodiments. In both thermographic and photothermographic materials, the thermally-releasable co-developers useful in this invention are incorporated into one or more imaging layers as defined below.

The thermographic and photothermographic materials of this invention can be used in black-and-white or color thermography and photothermography and in electronically generated black-and-white or color hardcopy recording. They can be used in microfilm applications, in radiographic imaging (for example digital medical imaging), X-ray radiography, and in industrial radiography. Furthermore, the absorbance of these thermographic and photothermographic materials between 350 and 450 nm is desirably low (less than 0.5), to permit their use in the graphic arts area (for example, imagesetting and photo-typesetting), in the manufacture of printing plates, in contact printing, in duplicating ("duping"), and in proofing.

The thermographic and photothermographic materials of this invention are particularly useful for medical imaging of human or animal subjects in response to visible or X-radiation. Such applications include, but are not limited to, thoracic imaging, mammography, dental imaging, orthopedic imaging, general medical radiography, therapeutic radiography, veterinary radiography, and auto-radiography. When used with X-radiation, the photothermographic materials of this invention may be used in combination with one or more phosphor intensifying screens, with phosphors incorporated within the photothermographic emulsion, or with a combination thereof. The materials of this invention are also useful for non-medical uses of visible or X-radiation (such as X-ray lithography and industrial radiography).

The photothermographic materials of this invention can be made sensitive to radiation of any suitable wavelength. Thus, in some embodiments, the materials are sensitive at ultraviolet, visible, infrared, or near infrared wavelengths of the electromagnetic spectrum. In other embodiments they are sensitive to X-radiation. Increased sensitivity to a particular region of the spectrum is imparted through the use of various sensitizing dyes.

The photothermographic materials of this invention are also useful for non-medical uses of visible or X-radiation (such as X-ray lithography and industrial radiography). In such imaging applications, it is often desirable that the photothermographic materials be "double-sided."

In the photothermographic materials of this invention, the components needed for imaging can be in one or more thermally developable layers. The layer(s) that contain the photosensitive photocatalyst (such as a photosensitive silver halide in photothermographic materials) or the non-photosensitive source of reducible silver ions, or both, are referred to herein as thermally developable layers or photothermographic emulsion layer(s). The photosensitive silver halide and the non-photosensitive source of reducible silver ions are in catalytic proximity (that is, in reactive association with each other) and preferably are in the same emulsion layer.

Similarly, in the thermographic materials of this invention, the components needed for imaging can be in one or more layers. The layer(s) that contain the non-photosensitive source of reducible silver ions are referred to herein as thermographic emulsion layer(s).

Where the materials contain imaging layers on one side of the support only, various non-imaging layers are usually disposed on the "backside" (non-emulsion or non-imaging side) of the materials, including antihalation layer(s), protective layers, antistatic layers, conducting layers, and transport enabling layers.

In such instances, various non-imaging layers can also be disposed on the "frontside" or imaging or emulsion side of the support, including protective topcoat layers, primer layers, interlayers, opacifying layers, antistatic layers, antihalation layers, acutance layers, auxiliary layers, and other layers readily apparent to one skilled in the art.

For some applications it may be useful that the photothermographic materials be "double-sided" and have photothermographic coatings on both sides of the support. In such constructions each side can also include one or more protective topcoat layers, primer layers, interlayers, antistatic layers, acutance layers, auxiliary layers, anti-crossover layers, and other layers readily apparent to one skilled in the art.

When the thermographic and photothermographic materials of this invention are heat-developed as described below in a substantially water-free condition after, or simultaneously with, imagewise exposure, a silver image (preferably a black-and-white silver image) is obtained.

Definitions

As used herein:

In the descriptions of the photothermographic materials of the present invention, "a" or "an" component refers to "at least one" of that component (for example, the thermally-releasable co-developers described herein).

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Eastman Kodak Company, Rochester, N.Y., 1977, p. 374.

"Photothermographic material(s)" means a construction comprising at least one photothermographic emulsion layer or a photothermographic set of layers, wherein the photosensitive silver halide and the source of reducible silver ions are in one layer and the other essential components or desirable additives are distributed, as desired, in the same layer or in an adjacent coating layer, as well as any supports, topcoat layers, image-receiving layers, blocking layers, antihalation layers, subbing, or priming layers. These materials also include multilayer constructions in which one or more imaging components are in different layers, but are in "reactive association" so that they readily come into contact with each other during imaging and/or development. For example, one layer can include the non-photosensitive source of reducible silver ions and another layer can include the reducing agent composition, but the two reactive components are in reactive association with each other.

"Thermographic materials" are similarly defined except that no photosensitive silver halide is present.

When used in photothermography, the term, "imagewise exposing" or "imagewise exposure" means that the material is imaged using any exposure means that provides a latent image using electromagnetic radiation. This includes, for example, by analog exposure where an image is formed by projection onto the photosensitive material as well as by digital exposure where the image is formed one pixel at a time such as by modulation of scanning laser radiation.

When used in thermography, the term, "imagewise exposing" or "imagewise exposure" means that the material is imaged using any means that provides an image using heat. This includes, for example, by analog exposure where an image is formed by differential contact heating through a mask using a thermal blanket or infrared heat source, as well as by digital exposure where the image is formed one pixel at a time such as by modulation of thermal print-heads.

"Catalytic proximity" or "reactive association" means that the materials are in the same layer or in adjacent layers so that they readily come into contact with each other during thermal imaging and development.

"Emulsion layer," "imaging layer," "thermographic emulsion layer," or "photothermographic emulsion layer" means a layer of a thermographic or photothermographic material that contains the photosensitive silver halide (when used) and/or non-photosensitive source of reducible silver ions. It can also mean a layer of the thermographic or photothermographic material that contains, in addition to the photosensitive silver halide (when used) and/or non-photosensitive source of reducible ions, additional essential components and/or desirable additives. These layers are usually on what is known as the "frontside" of the support.

"Photocatalyst" means a photosensitive compound such as silver halide that, upon exposure to radiation, provides a compound that is capable of acting as a catalyst for the subsequent development of the image-forming material.

"Ultraviolet region of the spectrum" refers to that region of the spectrum less than or equal to 410 nm, and preferably from about 100 nm to about 410 nm, although parts of these ranges may be visible to the naked human eye. More preferably, the ultraviolet region of the spectrum is the region of from about 190 to about 405 nm.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive.

The sensitometric terms "photospeed", "speed", or "photographic speed" (also known as sensitivity), absorbance, contrast, $D_{min}$, and $D_{max}$ have conventional definitions known in the imaging arts. In photothermographic materials, $D_{min}$ is considered herein as image density achieved when the photothermographic material is thermally developed without prior exposure to radiation. It is the average of eight lowest density values on the exposed side of the fiducial mark. In thermographic materials, $D_{min}$ is considered herein as image density in the non-thermally imaged areas of the thermographic material.

The sensitometric term absorbance is another term for optical density (OD).

"Transparent" means capable of transmitting visible light or imaging radiation without appreciable scattering or absorption.

As used herein, the phrase "organic silver coordinating ligand" refers to an organic molecule capable of forming a bond with a silver atom. Although the compounds so formed are technically silver coordination compounds they are also often referred to as silver salts.

The terms "double-sided" and "double-faced coating" are used to define photothermographic materials having one or more of the same or different thermally developable emulsion layers disposed on both sides (front and back) of the support.

In the compounds described herein, no particular double bond geometry (for example, cis or trans) is intended by the structures drawn. Similarly, the alternating single and double bonds and localized charges are drawn as a formalism. In reality, both electron and charge delocalization exists throughout the conjugated chain.

As is well understood in this art, for the chemical compounds herein described, substitution is not only tolerated, but is often advisable and various substituents are anticipated on the compounds used in the present invention unless otherwise stated. Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl"). For example, where a benzene ring structure is shown (including fused ring structures), substituent groups may be placed on the benzene ring structure, but the atoms making up the benzene ring structure may not be replaced.

As a means of simplifying the discussion and recitation of certain substituent groups, the term "group" refers to chemical species that may be substituted as well as those that are not so substituted. Thus, the term "group," such as "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group includes ether and thioether groups (for example $CH_3$—$CH_2$—$CH_2$—O—$CH_2$— and $CH_3$—$CH_2$—$CH_2$—S—$CH_2$—), haloalkyl, nitroalkyl, alkylcarboxy, carboxyalkyl, carboxamido, hydroxyalkyl, sulfoalkyl, and other groups readily apparent to one skilled in the art. Similarly, the term p-phenylenediamine group allows for substituents on the phenyl ring as well as on the nitrogen of the amino group. Substituents that adversely react with other active ingredients, such as very strongly electrophilic or oxidizing substituents, would, of course, be excluded by the ordinarily skilled artisan as not being inert or harmless.

*Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y. 10011).

Other aspects, advantages, and benefits of the present invention are apparent from the detailed description, examples, and claims provided in this application.

The Photocatalyst

As noted above, the photothermographic materials of the present invention include one or more photocatalysts in the photothermographic emulsion layer(s). Useful photocatalysts are typically silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. Silver bromide and silver bromoiodide are more preferred, with the latter silver halide generally having up to 10 mol % silver iodide. Typical techniques for preparing and precipitating silver halide grains are described in *Research Disclosure*, 1978, item 17643.

The shape of the photosensitive silver halide grains used in the present invention is in no way limited. The silver halide grains may have any crystalline habit including, but not limited to, cubic, octahedral, tetrahedral, orthorhombic, rhombic, dodecahedral, other polyhedral, tabular, laminar, twinned, or platelet morphologies and may have epitaxial growth of crystals thereon. If desired, a mixture of these crystals can be employed. Silver halide grains having cubic and tabular morphology are preferred.

The silver halide grains may have a uniform ratio of halide throughout. They may have a graded halide content, with a continuously varying ratio of, for example, silver bromide and silver iodide or they may be of the core-shell type, having a discrete core of one or more silver halides, and a discrete shell of one or more different silver halides. Core-shell silver halide grains useful in photothermographic materials and methods of preparing these materials are described for example in U.S. Pat. No. 5,382,504 (Shor et al.), incorporated herein by reference. Iridium and/or copper doped core-shell and non-core-shell grains are described in U.S. Pat. No. 5,434,043 (Zou et al.) and U.S. Pat. No. 5,939,249 (Zou), both incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halides be preformed and prepared by an ex-situ process. The silver halide grains prepared ex-situ may then be added to and physically mixed with the non-photosensitive source of reducible silver ions.

It is more preferable to form the source of reducible silver ions in the presence of ex-situ-prepared silver halide. In this process, the source of reducible silver ions, such as a long chain fatty acid silver carboxylate (commonly referred to as a silver "soap"), is formed in the presence of the preformed silver halide grains. Co-precipitation of the reducible source of silver ions in the presence of silver halide provides a more intimate mixture of the two materials [see, for example U.S. Pat. No. 3,839,049 (Simons)]. Materials of this type are often referred to as "preformed soaps."

The silver halide grains used in the imaging formulations can vary in average diameter of up to several micrometers ($\mu$m) depending on their desired use. Preferred silver halide grains are those having an average particle size of from about 0.01 to about 1.5 $\mu$m, more preferred are those having an average particle size of from about 0.03 to about 1.0 $\mu$m, and most preferred are those having an average particle size of from about 0.05 to about 0.8 $\mu$m. Those of ordinary skill in the art understand that there is a finite lower practical limit for silver halide grains that is partially dependent upon the wavelengths to which the grains are spectrally sensitized. Such a lower limit, for example, is typically from about 0.01 to about 0.005 $\mu$m.

The average size of the photosensitive doped silver halide grains is expressed by the average diameter if the grains are spherical, and by the average of the diameters of equivalent circles for the projected images if the grains are cubic or in other non-spherical shapes.

Grain size may be determined by any of the methods commonly employed in the art for particle size measurement. Representative methods are described by in "Particle Size Analysis," ASTM Symposium on Light Microscopy, R. P. Loveland, 1955, pp. 94–122, and in C. E. K. Mees and T. H. James, *The Theory of the Photographic Process*, Third Edition, Macmillan, New York, 1966, Chapter 2. Particle size measurements may be expressed in terms of the projected areas of grains or approximations of their diameters. These will provide reasonably accurate results if the grains of interest are substantially uniform in shape.

Preformed silver halide emulsions used in the material of this invention can be prepared by aqueous or organic processes and can be unwashed or washed to remove soluble salts. In the latter case, the soluble salts can be removed by ultrafiltration, by chill setting and leaching, or by washing the coagulum [for example, by the procedures described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et.al.), and U.S. Pat. No. 2,489,341 (Waller et al.)].

It is also effective to use an in-situ process in which a halide-containing compound is added to an organic silver salt to partially convert the silver of the organic silver salt to silver halide. The halogen-containing compound can be inorganic (such as zinc bromide or lithium bromide) or organic (such as N-bromosuccinimide).

Mixtures of both preformed and in-situ generated silver halide may be used if desired.

Additional methods of preparing these silver halide and organic silver salts and manners of blending them are described in *Research Disclosure*, June 1978, item 17029, U.S. Pat. No. 3,700,458 (Lindholm), U.S. Pat. No. 4,076,539 (Ikenoue et al.), and JP Applications 13224/74, 42529/76, and 17216/75.

In some instances, it may be helpful to prepare the photosensitive silver halide grains in the presence of a hydroxytetraazindene (such as 4-hydroxy-6-methyl- 1,3,3a,7-tetraazaindene or an N-heterocyclic compound comprising at least one mercapto group (such as 1-phenyl-5-mercaptotetrazole) to provide increased photospeed. Details of this procedure are provided in U.S. Pat. No. 6,413,710 (Shor et al.), that is incorporated herein by reference.

The one or more light-sensitive silver halides used in the photothermographic materials of the present invention are preferably present in an amount of from about 0.005 to about 0.5 mole, more preferably from about 0.01 to about 0.25 mole, and most preferably from about 0.03 to about 0.15 mole, per mole of non-photosensitive source of reducible silver ions.

Chemical Sensitizers

The photosensitive silver halides used in photothermographic features of the invention may be may be employed without modification. However, one or more conventional chemical sensitizers may be used in the preparation of the photosensitive silver halides to increase photospeed. Such compounds may contain sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process*, Fourth Edition, Eastman Kodak Company, Rochester, N.Y., 1977, Chapter 5, pp. 149–169. Suitable conventional chemical sensitization procedures are also described in U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), and EP 0 915 371A (Lok et al.).

In addition, mercaptotetrazoles and tetraazindenes as described in U.S. Pat. No. 5,691,127 (Daubendiek et al.), incorporated herein by reference, can be used as suitable addenda for tabular silver halide grains.

When used, sulfur sensitization is usually performed by adding a sulfur sensitizer and stirring the emulsion at an appropriate temperature predetermined time. Examples of sulfur sensitizers include compounds such as thiosulfates, thioureas, thiazoles, rhodanines, thiosulfates and thioureas. In one preferred embodiment, chemical sensitization is achieved by oxidative decomposition of a sulfur-containing spectral sensitizing dye in the presence of a photothermographic emulsion. Such sensitization is described in U.S. Pat. No. 5,891,615 (Winslow et al.), incorporated herein by reference.

In another embodiment, certain substituted and unsubstituted thiourea compounds can be used as chemical sensitizers. Particularly useful tetra-substituted thioureas are described in U.S. Pat. No. 6,368,779 (Lynch et al.), that is incorporated herein by reference.

Other useful chemical sensitizers include certain tellurium-containing compounds that are described in copending and commonly assigned U.S. Published Application 2002-0164549 (Lynch et al.) that is incorporated herein by reference. Combinations of gold (3+)-containing compounds and either sulfur- or tellurium-containing compounds are also useful as chemical sensitizers as described in U.S. Pat. No. 6,423,481 (Simpson et al.), that is also incorporated herein by reference.

Still other useful chemical sensitizers include certain selenium-containing compounds that are described in copending and commonly assigned U.S. Ser. No. 10/082,516 (filed Feb. 25, 2002 by Lynch, Opatz, Gysling, and Simpson), that is also incorporated herein by reference.

The chemical sensitizers can be used in making the silver halide emulsions in conventional amounts that generally depend upon the average size of the silver halide grains. Generally, the total amount is at least $10^{-10}$ mole per mole of total silver, and preferably from about $10^{-8}$ to about $10^{-2}$ mole per mole of total silver for silver halide grains having an average size of from about 0.01 to about 2 $\mu$m. The upper limit can vary depending upon the compound(s) used, the level of silver halide and the average grain size, and would be readily determinable by one of ordinary skill in the art.

Spectral Sensitizers

The photosensitive silver halides used in the photothermographic features of the invention may be spectrally sensitized with various spectral sensitizing dyes that are known to enhance silver halide sensitivity to ultraviolet, visible, and/or infrared radiation. Non-limiting examples of sensitizing dyes that can be employed. include cyanine dyes, merocyanine dyes, complex cyanine dyes, complex merocyanine dyes, holopolar cyanine dyes, hemicyanine dyes, styryl dyes, and hemioxanol dyes. Cyanine dyes are particularly useful. The cyanine dyes preferably include benzothiazole, benzoxazole, and benzoselenazole dyes that include one or more thioalkyl, thioaryl, or thioether groups. Suitable visible sensitizing dyes such as those described in U.S. Pat. No. 3,719,495 (Lea), U.S. Pat. No. 4,439,520 (Kofron et al.), and U.S. Pat. No. 5,281,515 (Delprato et al.) are effective in the practice of the invention. Suitable infrared sensitizing dyes such as those described in U.S. Pat. No. 5,393,654 (Burrows et al.), U.S. Pat. No. 5,441,866 (Miller et al.) and U.S. Pat. No. 5,541,054 (Miller et al.) are also effective in the practice of this invention. A summary of generally useful spectral sensitizing dyes is contained in *Research Disclosure*, item 308119, Section IV, December, 1989. Additional classes of dyes useful for spectral sensitization, including sensitization at other wavelengths are described in *Research Disclosure*, 1994, item 36544, section V. All of the references and patents above are incorporated herein by reference.

An appropriate amount of spectral sensitizing dye added is generally about $10^{-10}$ to $10^{-1}$ mole, and preferably, about $10^{-7}$ to $10^{-2}$ mole per mole of silver halide.

Non-Photosensitive Source of Reducible Silver Ions

The non-photosensitive source of reducible silver ions used in the thermographic and photothermographic materials of this invention can be any metal-organic compound that contains reducible silver (1+) ions. Such compounds are generally silver salts of silver coordinating ligands. Preferably, it is an organic silver salt that is comparatively stable to light and forms a silver image when heated to 50° C. or higher in the presence of an exposed photocatalyst (such as silver halide, when used in a photothermographic material) and a reducing agent composition.

Silver salts of organic acids including silver salts of long-chain aliphatic carboxylic acids are preferred. The chains typically contain 10 to 30, and preferably 15 to 28, carbon atoms. Suitable organic silver salts include silver salts of organic compounds having a carboxylic acid group. Examples thereof include a silver salt of an aliphatic carboxylic acid or a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Preferably, at least silver behenate is used alone or in mixtures with other silver salts.

Representative examples of useful silver salts of aromatic carboxylic acid and other carboxylic acid group-containing compounds include, but are not limited to, silver benzoates, silver substituted-benzoates (such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate), silver tannate, silver phthalate, silver terephthalate, silver salicylate, silver phenylacetate, and silver pyromellitate.

Silver salts of aliphatic carboxylic acids containing a thioether group as described in U.S. Pat. No. 3,330,663 (Weyde et al.) are also useful. Soluble silver carboxylates comprising hydrocarbon chains incorporating ether or thioether linkages, or sterically hindered substitution in the $\alpha$-(on a hydrocarbon group) or ortho-(on an aromatic group) position, and displaying increased solubility in coating solvents and affording coatings with less light scattering can also be used. Such silver carboxylates are described in U.S. Pat. No. 5,491,059 (Whitcomb). Mixtures of any of the silver salts described herein can also be used if desired.

Silver salts of dicarboxylic acids are also useful. Such acids may be aliphatic, aromatic, or heterocyclic. Examples of such acids include, for example, phthalic acid, glutamic acid, or homo-phthalic acid.

Silver salts of sulfonates are also useful in the practice of this invention. Such materials are described for example in U.S. Pat. No. 4,504,575 (Lee). Silver salts of sulfosuccinates are also useful as described for example in EP 0 227 141 A (Leenders et al.).

Silver salts of compounds containing mercapto or thione groups and derivatives thereof can also be used. Preferred examples of these compounds include, but are not limited to, a heterocyclic nucleus containing 5 or 6 atoms in the ring, at least one of which is a nitrogen atom, and other atoms being carbon, oxygen, or sulfur atoms. Such heterocyclic nuclei include, but are not limited to, triazoles, oxazoles, thiazoles, thiazolines, imidazoles, diazoles, pyridines, and triazines. Representative examples of these silver salts include, but are not limited to, a silver salt of 3-mercapto-4-phenyl-1,2,4-triazole, a silver salt of 5-carboxylic-1-methyl-2-phenyl-4-thiopyridine, a silver salt of mercaptotriazine, a silver salt of 2-mercaptobenzoxazole, silver salts as described in U.S. Pat. No. 4,123,274 (Knight et al.) (for example, a silver salt of a 1,2,4-mercaptothiazole derivative, such as a silver salt of 3-amino-5-benzylthio-1,2,4-thiazole), and a silver salt of thione compounds [such as a silver salt of 3-(2-carboxyethyl)-4-methyl-4-thiazoline-2-thione as described in U.S. Pat. No. 3,785,830 (Sullivan et al.)].

Examples of other useful silver salts of mercapto or thione substituted compounds that do not contain a heterocyclic nucleus include but are not limited to, a silver salt of thioglycolic acids such as a silver salt of an S-alkylthioglycolic acid (wherein the alkyl group has from 12 to 22 carbon atoms), a silver salt of a dithiocarboxylic acid such as a silver salt of a dithioacetic acid, and a silver salt of a thioamide.

In some embodiments, a silver salt of a compound containing an imino group can be used. Preferred examples of these compounds include, but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Particularly useful silver salts of this type are the silver salts of benzotriazole and substituted derivatives thereof.

Moreover, silver salts of acetylenes can also be used as described, for example in U.S. Pat. No. 4,761,361 (Ozaki et al.) and U.S. Pat. No. 4,775,613 (Hirai et al.).

Organic silver salts that are particularly useful in organic solvent-based photothermographic materials include silver carboxylates (both aliphatic and aromatic carboxylates), silver triazolates, silver sulfonates, silver sulfo-succinates, and silver acetylides. Silver salts of long-chain aliphatic carboxylic acids containing 15 to 28, carbon atoms and silver salts are particularly preferred.

It is also convenient to use silver half soaps. A preferred example of a silver half soap is an equimolar blend of silver carboxylate and carboxylic acid, which analyzes for about 14.5% by weight solids of silver in the blend and which is prepared by precipitation from an aqueous solution of an ammonium or an alkali metal salt of a commercially available fatty carboxylic acid, or by addition of the free fatty acid to the silver soap. For transparent films a silver carboxylate full soap, containing not more than about 15% of free fatty carboxylic acid and analyzing for about 22% silver, can be used. For opaque thermographic and photothermographic materials, different amounts can be used.

The methods used for making silver soap emulsions are well known in the art and are disclosed in *Research Disclosure*, April 1983, item 22812, *Research Disclosure*, October 1983, item 23419, U.S. Pat. No. 3,985,565 (Gabrielsen et al.), and the references cited above.

Non-photosensitive sources of reducible silver ions can also be provided as core-shell silver salts such as those described in U.S. Pat. No. 6,355,408 (Whitcomb et al.), that is incorporated herein by reference. These silver salts include a core comprised of one or more silver salts and a shell having one or more different silver salts.

Another useful source of non-photosensitive reducible silver ions in the practice of this invention are the silver dimer compounds that comprise two different silver salts as described in U.S. Pat. No. 6,472,131 (Whitcomb), that is incorporated herein by reference. Such non-photosensitive silver dimer compounds comprise two different silver salts, provided that when the two different silver salts comprise straight-chain, saturated hydrocarbon groups as the silver coordinating ligands, those ligands differ by at least 6 carbon atoms.

Still other useful sources of non-photosensitive reducible silver ions in the practice of this invention are the silver core-shell compounds comprising a primary core comprising one or more photosensitive silver halides, or one or more non-photosensitive inorganic metal salts or non-silver containing organic salts, and a shell at least partially covering the primary core, wherein the shell comprises one or more non-photosensitive silver salts, each of which silver salts comprises a organic silver coordinating ligand. Such compounds are described in copending and commonly assigned U.S. Ser. No. 10/208,603 (filed Jul. 30, 2002 by Bokhonov, Burleva, Whitcomb, Howlader, and Leichter), that is incorporated herein by reference.

As one skilled in the art would understand, the non-photosensitive source of reducible silver ions can include various mixtures of the various silver salt compounds described herein, in any desirable proportions.

When used in photothermographic materials, the photocatalyst and the non-photosensitive source of reducible silver ions must be in catalytic proximity (that is, reactive association). It is preferred that these reactive components be present in the same emulsion layer.

The one or more non-photosensitive sources of reducible silver ions are preferably present in an amount of about 5% by weight to about 70% by weight, and more preferably, about 10% to about 50% by weight, based on the total dry weight of the emulsion layers. Stated another way, the amount of the sources of reducible silver ions is generally present in an amount of from about 0.001 to about 0.2 $mol/m^2$ of the dry photothermographic material, and preferably from about 0.01 to about 0.05 $mol/m^2$ of that material.

The total amount of silver (from all silver sources) in the thermographic and photothermographic materials is generally at least 0.002 $mol/m^2$ and preferably from about 0.01 to about 0.05 $mol/m^2$.

Reducing Agent Compositions

When used in a photothermographic material, the reducing agent composition for the source of reducible silver ions includes at least two essential components one of which is a hindered phenol reducing agent that can reduce silver (1+) ion to metallic silver. The other essential component is a thermally-releasable co-developer that is described in more detail below. The reducing composition can include other components such as "contrast enhancing" agents as described below.

"Hindered phenol reducing agents" are compounds that contain only one hydroxy group on a given phenyl ring and have at least one additional substituent located ortho to the hydroxy group. Hindered phenol reducing agents may contain more than one hydroxy group as long as each hydroxy group is located on different phenyl rings. Hindered phenol reducing agents include, for example, binaphthols (that is dihydroxybinaphthyls), biphenols (that is dihydroxybiphenyls), bis(hydroxynaphthyl)methanes, bis(hydroxyphenyl)methanes (that is bis-phenols), hindered phenols, and hindered naphthols, each of which may be variously substituted.

Representative binaphthols include, but are not limited, to 1,1'-bi-2-naphthol, 1,1'-bi-4-methyl-2-naphthol and 6,6'-dibromo-bi-2-naphthol. For additional compounds see U.S. Pat. No. 3,094,417 (Workman) and U.S. Pat. No. 5,262,295 (Tanaka et al.), both incorporated herein by reference.

Representative biphenols include, but are not limited, to 2,2'-dihydroxy-3,3'-di-t-butyl-5,5-dimethylbiphenyl, 2,2'-dihydroxy-3,3',5,5'-tetra-t-butylbiphenyl, 2,2'-dihydroxy-3,3'-di-t-butyl-5,5'-dichloro-biphenyl, 2-(2-hydroxy-3-t-butyl-5-methylphenyl)-4-methyl-6-n-hexylphenol, 4,4'-dihydroxy-3,3',5,5'-tetra-t-butylbiphenyl and 4,4'-dihydroxy-3,3',5,5'-tetra-methylbiphenyl. For additional compounds see U.S. Pat. No. 5,262,295 (noted above).

Representative bis(hydroxynaphthyl)methanes include, but are not limited to, 4,4'-methylenebis(2-methyl-1-naphthol). For additional compounds see U.S. Pat. No. 5,262,295 (noted above).

Representative bis(hydroxyphenyl)methanes include, but are not limited to, bis(2-hydroxy-3-t-butyl-5-methylphenyl) methane (CAO-5), 1,1'-bis(2-hydroxy-3,5-dimethylphenyl)-3,5,5-trimethylhexane (NONOX® or PERMANAX WSO), 1,1'-bis(3,5-di-t-butyl-4-hydroxyphenyl)methane, 2,2'-bis(4-hydroxy-3-methylphenyl)propane, 4,4'-ethylidene-bis(2-t-butyl-6-methylphenol), 2,2'-isobutylidene-bis(4,6-dimethylphenol) (LOWINOX® 221B46), and 2,2'-bis(3,5-dimethyl-4-hydroxyphenyl)propane. For additional compounds see U.S. Pat. No. 5,262,295 (noted above).

Representative hindered phenols include, but are not limited to, 2,6-di-t-butylphenol, 2,6-di-t-butyl-4-methylphenol, 2,4-di-t-butylphenol, 2,6-dichlorophenol, 2,6-dimethylphenol and 2-t-butyl-6-methylphenol.

Representative hindered naphthols include, but are not limited to, 1-naphthol, 4-methyl-1-naphthol, 4-methoxy-1-naphthol, 4-chloro-1-naphthol and 2-methyl-1-naphthol. For additional compounds see U.S. Pat. No. 5,262,295 (noted above).

Mixtures of hindered phenol reducing agents can be used if desired.

When used in a thermographic material, the reducing agent composition for the source of reducible silver ions also includes at least two essential components one of which is an aromatic di- or tri-hydroxy compound. The other essential component is a thermally-releasable co-developer that is described in more detail below. The reducing composition can include other components such as "contrast enhancing" agents as described below. Mixtures of di- or tri-hydroxy compounds can be used if desired.

Preferred reducing agents are aromatic di- and tri-hydroxy compounds having at least two hydroxy groups in ortho- or para-relationship on the same aromatic nucleus. Examples are hydroquinone and substituted hydroquinones, catechols, pyrogallol, gallic acid and gallic acid esters (for example, methyl gallate, ethyl gallate, propyl gallate), and tannic acid.

Particularly preferred are reducing catechol-type reducing agents having no more than two hydroxy groups in an ortho-relationship. Preferred catechol-type reducing agents include, for example, catechol, 3-(3,4-dihydroxy-phenyl)-propionic acid, 2,3-dihydroxy-benzoic acid, 2,3-dihydroxy-benzoic acid esters, 3,4-dihydroxy-benzoic acid, and 3,4-dihydroxy-benzoic acid esters.

One particularly preferred class of catechol-type reducing agents are benzene compounds in which the benzene nucleus is substituted by no more than two hydroxy groups which are present in 2,3-position on the nucleus and have in the 1-position of the nucleus a substituent linked to the nucleus by means of a carbonyl group. Compounds of this type include 2,3-dihydroxy-benzoic acid, methyl 2,3-dihydroxy-benzoate, and ethyl 2,3-dihydroxy-benzoate.

Another particularly preferred class of catechol-type reducing agents are benzene compounds in which the benzene nucleus is substituted by no more than two hydroxy groups which are present in 3,4-position on the nucleus and have in the 1-position of the nucleus a substituent linked to the nucleus by means of a carbonyl group. Compounds of this type include, for example, 3,4-dihydroxy-benzoic acid, methyl 3,4-dihydroxy-benzoate, ethyl 3,4-dihydroxy-benzoate, 3,4-dihydroxy-benzaldehyde, and phenyl-(3,4-dihydroxyphenyl)ketone. Such compounds are described, for example, in U.S. Pat. No. 5,582,953 (Uyttendaele et al.).

Still another particularly useful class of reducing agents are polyhydroxy spiro-bis-indane compounds described as photographic tanning agents in U.S. Pat. No. 3,440,049 (Moede). Examples include 3,3,3',3'-tetramethyl-5,6,5',6'-tetrahydroxy 1,1'-spiro-bis-indane (called indane I) and 3,3,3',3'-tetramethyl-4,6,7,4',6',7'-hexahydroxy- 1,1'-spiro-bis-indane (called indane II).

In addition to the combination of aromatic di- and tri-hydroxy reducing agents and the thermally-releasable p-phenylenediamine co-developers additional developers (such as the hindered phenol reducing agents described above), co-developers, high contrast co-developing agents, and co-developer contrast-enhancing agents can be used. These materials are described below.

As noted above, in the thermally-developable materials of this invention, combinations of one or more hindered phenol developers and one or more aromatic di- or tri-hydroxy compounds may be used.

The second essential component of the reducing agent composition is a thermally-releasable p-phenylenediamine co-developer as described below. Mixtures of either or both types of these compounds can be used if desired.

Such co-developers generally comprise a blocking group that is cleaved upon exposure to at least 120° C. for at least 5 seconds to release a p-phenylenediamine compound. These co-developers are also represented by the following Structure I:

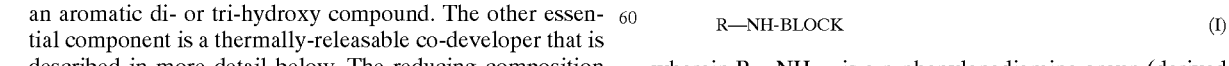

R—NH-BLOCK (I)

wherein R—NH— is a p-phenylenediamine group (derived from a p-phenylene-diamine from which a hydrogen has been removed from an amino group) and BLOCK is a blocking group that is cleaved upon exposure to at least 120° C. for at least 5 seconds. For example, BLOCK comprises one or more of the following thermally cleavable groups:

—CONH—, —COO—, —$CONHSO_2$—, —$PO_3$—, —$SO_2$—, —$COCH_2NHCO$—, and —COS—. BLOCK preferably is directly linked or bonded (no intermediate linking atoms) to R—NH—through one of these thermally cleavable groups.

Preferably, the thermally-releasable p-phenylenediamine co-developer is represented by the following Structure II:

(II)

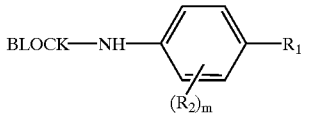

wherein $R_1$ is an amino group.

Preferably, $R_1$ is a secondary amino group having the formula —$NH(R_4)$ or a tertiary amino group having the formula —$N(R_4)(R_5)$ wherein $R_4$ and $R_5$ independently represent hydrogen, substituted or unsubstituted alkyl groups (including alkylenearyl groups such as benzyl), substituted or unsubstituted aryl groups (including arylene-alkyl groups such as tolyl), substituted or unsubstituted cycloalkyl groups, substituted or unsubstituted alkenyl groups, substituted or unsubstituted alkynyl groups, and heterocyclyl groups.

Useful alkyl groups are branched or linear and can have from 1 to 20 carbon atoms (preferably having 1 to 5 carbon atoms), useful aryl groups can have from 6 to 14 carbon atoms in the carbocyclic ring, useful cycloalkyl groups can have from 5 to 14 carbon atoms in the central ring system, useful alkenyl and alkynyl groups can be branched or linear and have from 2 to 20 carbon atoms, and useful heterocyclyl groups can have 5 to 10 carbon, oxygen, sulfur and nitrogen atoms in the central ring system and can also have fused rings.

These various groups can be further substituted with one or more groups including but not limited to, halo groups, alkoxycarbonyl groups, hydroxy groups, alkoxy groups, cyano groups, acyl groups, acyloxy groups, carbonyloxy ester groups, sulfonic acid ester groups, alkylthio groups, dialkylamino groups, carboxylic acid groups, sulfonic acid groups, hydroxylamino groups, sulfo groups, phosphono groups, and any other group readily apparent to one skilled in the art. $R_4$ and $R_5$ can independently be alkyl groups.

Alternatively, $R_4$ and $R_5$ taken together can form a substituted or unsubstituted 5- to 7-membered heterocyclic ring. In such instances the heterocyclic rings can be saturated or unsaturated and can contain oxygen, nitrogen or sulfur atoms in addition to carbon atoms. Useful rings of this type include, but are not limited to, imidazole, pyrroline, pyrrolidine, thiohydantoin, pyridone, morpholine, piperazine and thiomorpholine rings. These rings can be substituted with one or more linear or branched alkyl groups (having 1 to 5 carbon atoms), aryl groups (having 6 to 10 carbon atoms in the central ring system), cycloalkyl groups (having 5 to 10 carbon atoms in the central ring system), alkoxy groups, carbonyloxyester groups, halo groups, cyano groups, hydroxy groups, acyl groups, alkoxycarbonyl groups, sulfonic ester groups, alkylthio groups, carbonyl groups, carboxylic acid groups, sulfonic acid groups, hydroxylamino groups, sulfo groups, phosphono groups, and other groups readily apparent to one skilled in the art.

Preferably, $R_1$ is a tertiary amino group wherein $R_4$ and $R_5$ independently represent alkyl, alkenyl, alkynyl, aryl, and heterocyclyl groups. More preferably $R_4$ and $R_5$ independently represent alkyl, aryl, and alkenyl groups. Most preferably $R_4$ and $R_5$ represent linear or branched alkyl groups having from 1 to 4 carbon atoms. Specifically preferred $R_4$ and $R_5$ groups are methyl, ethyl, butyl, and cyanoethyl.

Each $R_2$ group is hydrogen, or a substituted or unsubstituted alkyl, alkenyl, alkoxy, or alkylthio group having 1 to 6 carbon atoms, or a halo group. Preferably, $R_2$ is hydrogen or a substituted or unsubstituted methyl or ethyl group or a chloro group.

In addition, m is 0, 1, or 2 (preferably it is 0 or 1), and BLOCK is any of the following groups BLOCK-1 through BLOCK-8:

| | |
|---|---|
| BLOCK-1 | —CONH—$R_3$ (ureido group) |
| BLOCK-2 | —COO—$R_3$ (carbamoyl group) |
| BLOCK-3 | —$CONHSO_2$—$R_3$ |
| BLOCK-4 | 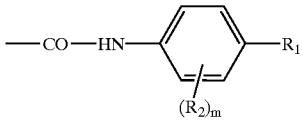 |
| BLOCK-5 | —$SO_2$—$R_3$ |
| BLOCK-6 | —PO—$(OR_3)_2$ (phosphate group) |
| BLOCK-7 | —$COCH_2NHCO$—$R_3$ |
| BLOCK-8 | —COS—$R_3$ |

wherein $R_3$ is a substituted or unsubstituted alkyl, alkenyl, aryl, cycloalkyl, or heterocyclyl group.

Useful alkyl groups are branched or linear and can have from 1 to 20 carbon atoms (preferably having 1 to 5 carbon atoms), useful aryl groups can have from 6 to 14 carbon atoms in the carbocyclic ring, useful cycloalkyl groups can have from 5 to 14 carbon atoms in the central ring system, useful alkenyl groups can be branched or linear and have from 2 to 20 carbon atoms, and useful heterocyclyl groups can have 5 to 10 carbon, oxygen, sulfur and nitrogen atoms in the central ring system and can also have fused rings.

Preferably, $R_3$ is a substituted or unsubstituted alkyl or an alkenyl group of from 1 to 20 carbon atoms, or a heterocyclyl group having at least 3 carbon atoms, or an aryl group of at least 4 carbon atoms. More preferably, $R_3$ is an alkyl group of from 1 to 4 carbon atoms, a phenyl group, or a p-tolyl group.

The thermally-releasable p-phenylenediamine co-developers can be prepared using common reagents and techniques apparent to those skilled in the art. For example, urido and carbamoyl compounds can be prepared by reaction of an appropriate p-pheylenediamine with an isocyanate. Such syntheses are described, for example, in U.S. Pat. No. 4,426,441 (Adin et al.).

Representative thermally-releasable p-phenylenediamine co-developers are the following compounds CD-1 through CD-15. CD-1 is the most preferred co-developer.

(CD-1)

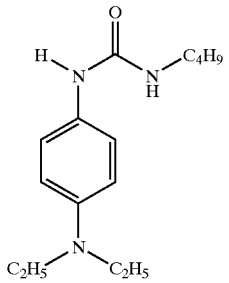

-continued
(CD-2)
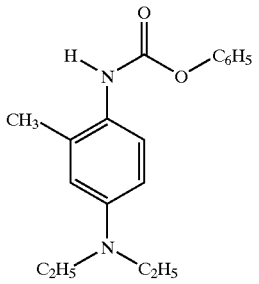
(CD-3)
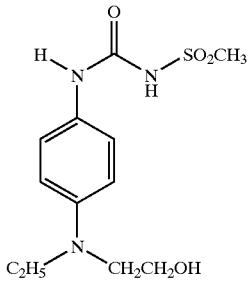
(CD-4)
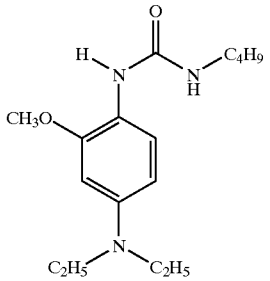
(CD-5)
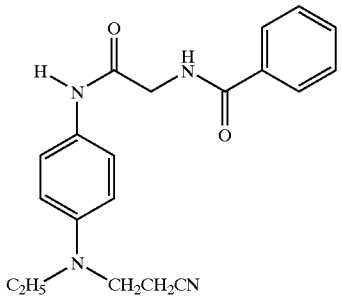
(CD-6)
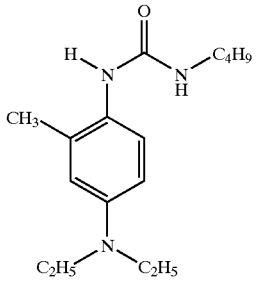
-continued
(CD-7)
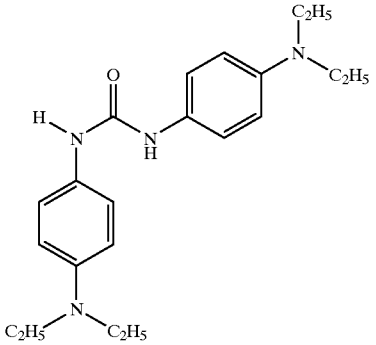
(CD-8)
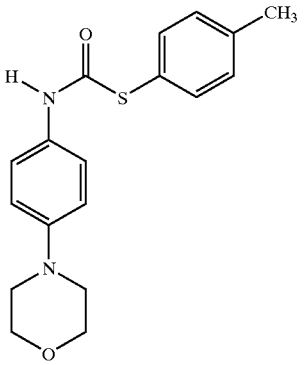
(CD-9)
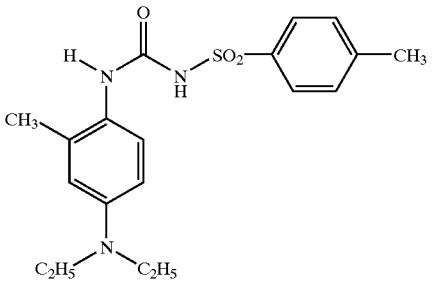
(CD-10)
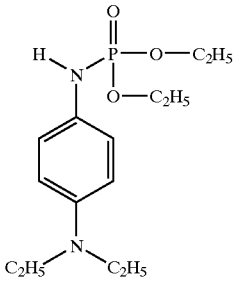
(CD-11)
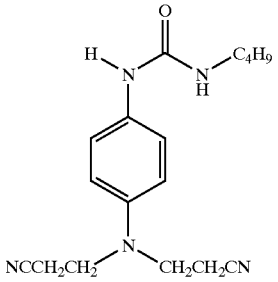

-continued (CD-12)

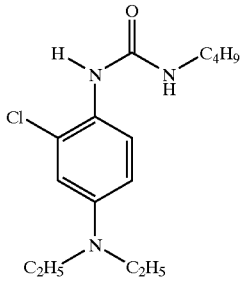

(CD-13)

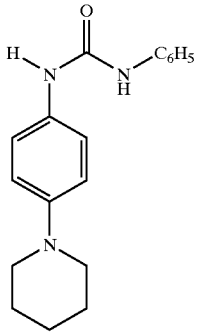

(CD-14)

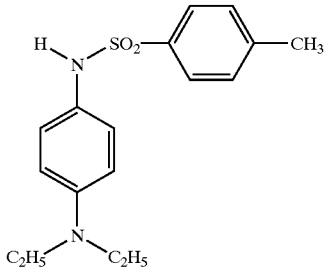

(CD-15)

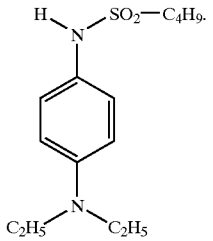

Various contrast enhancing. agents can be used in some photothermographic materials. Examples of useful contrast enhancing agents include, but are not limited to, hydroxylamines (including hydroxylamine and alkyl- and aryl-substituted derivatives thereof), alkanolamines and ammonium phthalamate compounds as described for example, in U.S. Pat. No. 5,545,505 (Simpson), hydroxamic acid compounds as described for example, in U.S. Pat. No. 5,545,507 (Simpson et al.), N-acylhydrazine compounds as described for example, in U.S. Pat. No. 5,558,983 (Simpson et al.), and hydrogen atom donor compounds as described in U.S. Pat. No. 5,637,449 (Harring et al.). All of the patents above are incorporated herein by reference.

In preferred photothermographic embodiments, the hindered phenol reducing agent, aromatic di- or tri-hydroxy compound, or mixture thereof, and the thermally-releasable p-phenylenediamine co-developer are present in the same imaging layer although they can be in different adjacent layers. The molar ratio of the hindered phenol reducing agent to the thermally-releasable p-phenylene-diamine co-developer is at least 10:1, and preferably the molar ratio is from about 5:1 to about 1:1.

The amount of the hindered phenol reducing agent, aromatic di- or tri-hydroxy compound, or mixture thereof, in an imaging layer is at least 0.4 g/m$^2$ and the amount of the thermally-releasable p-phenylenediamine co-developer is at least 0.2 g/m$^2$. Preferably, these amounts are from about 0.5 to about 1.5 g/m$^2$ of hindered phenol reducing agent, and from about 0.25 to about 1.0 g/m$^2$ of the thermally-releasable co-developer in the same imaging layer.

Particularly useful embodiments of this invention include black-and-white photothermographic materials that comprise a support having thereon:

a) one or more thermally developable imaging layers each comprising a hydrophobic binder, and in reactive association, a photosensitive silver bromide or silver iodobromide, a non-photosensitive source of reducible silver ions that includes one or more silver carboxylates at least one of which is silver behenate, a reducing composition for the non-photosensitive source of reducible silver ions that includes at least one bis-phenol reducing agent and a thermally-releasable p-phenylenediamine co-developer that is represented by the following Structure II:

(II)

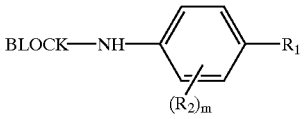

wherein $R_1$ is an amino group, $R_2$ is hydrogen, or a substituted or unsubstituted, alkyl, alkenyl, alkoxy, thioalkyl, or halo group, m is 0, 1, or 2, and BLOCK is any of the following groups BLOCK-1 through BLOCK-8:

| | |
|---|---|
| BLOCK-1 | —CONH—$R_3$ (ureido group) |
| BLOCK-2 | —COO—$R_3$ (carbamoyl group) |
| BLOCK-3 | —CONHSO$_2$—$R_3$ |
| BLOCK-4 | 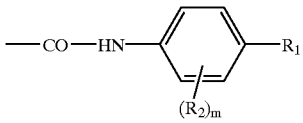 |
| BLOCK-5 | —SO$_2$—$R_3$ |
| BLOCK-6 | —PO—(OR$_3$)$_2$ (phosphate group) |
| BLOCK-7 | —COCH$_2$NHCO—$R_3$ |
| BLOCK-8 | —COS—$R_3$ |

wherein $R_3$ is substituted or unsubstituted alky, alkenyl, aryl, cycloalkyl, or heterocyclyl group, wherein the molar ratio of the bis-phenol reducing agent to the thermally-releasable p-phenylenediamine co-developer is from about 5:1 to about 1:1, the bis-phenol reducing agent is present in an amount of from about 0.5 to about 1.5 g/m$^2$, and the thermally-releasable p-phenylenediamine co-developer is present in an amount of from about 0.25 to about 1.0 g/m$^2$, and b) a protective overcoat disposed over the one or more thermally developable imaging layers, an antihalation layer on the backside, or both the protective layer and the antihalation layer.

Other Addenda

The thermographic and photothermographic materials of this invention can also contain other additives such as shelf-life stabilizers, antifoggants, contrast enhancers, development accelerators, acutance dyes, post-processing stabilizers or stabilizer precursors, thermal solvents (also known as melt formers), and other image-modifying agents as would be readily apparent to one skilled in the art.

To further control the properties of photothermographic materials, (for example, contrast, $D_{min}$, speed, or fog), it may be preferable to add one or more heteroaromatic mercapto compounds or heteroaromatic disulfide compounds of the formulae Ar—S—$M^1$ and Ar—S—S—Ar, wherein $M^1$ represents a hydrogen atom or an alkali metal atom and Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Compounds having other heteroaromatic rings and compounds providing enhanced sensitization at other wavelengths are also envisioned to be suitable. For example, heteroaromatic mercapto compounds are described as supersensitizers for infrared photothermographic materials in EP 0 559 228 B1 (Philip Jr. et al.).

The heteroaromatic ring may also carry substituents. Examples of preferred substituents are halo groups (such as bromo and chloro), hydroxy, amino, carboxy, alkyl groups (for example, of 1 or more carbon atoms and preferably 1 to 4 carbon atoms), and alkoxy groups (for example, of 1 or more carbon atoms and preferably of 1 to 4 carbon atoms).

Heteroaromatic mercapto compounds are most preferred. Examples of preferred heteroaromatic mercapto compounds are 2-mercaptobenz-imidazole, 2-mercapto-5-methylbenzimidazole, 2-mercaptobenzothiazole and 2-mercaptobenzoxazole, and mixtures thereof.

If used, a heteroaromatic mercapto compound is generally present in an emulsion layer in an amount of at least about 0.0001 mole per mole of total silver in the emulsion layer. More preferably, the heteroaromatic mercapto compound is present within a range of about 0.001 mole to about 1.0 mole, and most preferably, about 0.005 mole to about 0.2 mole, per mole of total silver.

The photothermographic materials of the present invention can be further protected against the production of fog and can be stabilized against loss of sensitivity during storage. While not necessary for the practice of the invention, it may be advantageous to add mercury (2+) salts to the emulsion layer(s) as an antifoggant. Preferred mercury (2+) salts for this purpose are mercuric acetate and mercuric bromide. Other useful mercury salts include those described in U.S. Pat. No. 2,728,663 (Allen).

Other suitable antifoggants and stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), compounds having —$SO_2CBr_3$ groups as described for example in U.S. Pat. No. 5,594,143 (Kirk et al.) and U.S. Pat. No. 5,374,514 (Kirk et al.), and 2-(tribromomethylsulfonyl)quinoline compounds as described in U.S. Pat. No. 5,460,938 (Kirk et al.).

Stabilizer precursor compounds capable of releasing stabilizers upon application of heat during development can also be used. Such precursor compounds are described in for example, U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzo-triazoles (for example alkylsulfonylbenzotriazoles and arylsulfonylbenzotriazoles) have been found to be useful stabilizing compounds (such as for post-processing print stabilizing), as described in U.S. Pat. No. 6,171,767 (Kong et al.).

Furthermore, other specific useful antifoggants/stabilizers are described in more detail in U.S. Pat. No. 6,083,681 (Lynch et al.), incorporated herein by reference.

Other antifoggants are hydrobromic acid salts of heterocyclic compounds (such as pyridinium hydrobromide perbromide) as described, for example, in U.S. Pat. No. 5,028,523 (Skoug), benzoyl acid compounds as described, for example, in U.S. Pat. No. 4,784,939 (Pham), substituted propenenitrile compounds as described, for example, in U.S. Pat. No. 5,686,228 (Murray et al.), silyl blocked compounds as described, for example, in U.S. Pat. No. 5,358,843 (Sakizadeh et al.), vinyl sulfones as described, for example, in U.S. Pat. No. 6,143,487 (Philip, Jr. et al.), diisocyanate compounds as described, for example, in EP 0 600 586 A1 (Philip, Jr. et al.), and tribromomethylketones as described, for example, in EP 0 600 587 A1 (Oliffet al.).

Preferably, the photothermographic materials of this invention include one or more polyhalo antifoggants that include one or more polyhalo substituents including but not limited to, dichloro, dibromo, trichloro, and tribromo groups. The antifoggants can be aliphatic, alicyclic or aromatic compounds, including aromatic heterocyclic and carbocyclic compounds.

Particularly useful antifoggants are polyhalo antifoggants, such as those having a —$SO_2C(X')_3$ group wherein X' represents the same or different halogen atoms.

Advantageously, the photothermographic materials of this invention also include one or more thermal solvents (or melt formers). Representative examples of such compounds include, but are not limited to, salicylanilide, phthalimide, N-hydroxyphthalimide, N-potassium-phthalimide, succinimide, N-hydroxy- 1,8-naphthalimide, phthalazine, 1-(2H)-phthalazinone, 2-acetylphthalazinone, benzanilide, dimethylurea, D-sorbitol, and benzene-sulfonamide. Combinations of these compounds can also be used including a combination of succinimide and dimethylurea. Known thermal solvents are disclosed, for example, in U.S. Pat. No. 3,438,776 (Yudelson), U.S. Pat. No. 5,250,386 (Aono et al.), U.S. Pat. No. 5,368,979 (Freedman et al.), U.S. Pat. No. 5,716,772 (Taguchi et al.), and U.S. Pat. No. 6,013,420 (Windender).

It is often advantageous to include a base-release agent or base precursor in the photothermographic materials according to the invention to provide improved and more effective image development. A base-release agent or base precursor as employed herein is intended to include compounds which upon heating in the photothermographic material provide a more effective reaction between the described photosensitive silver halide, and the image-forming combination comprising a silver salt and the silver halide developing agent. Representative base-release agents or base precursors include guanidinium compounds, such as guanidinium trichloroacetate, and other compounds that are known to release a base but do not adversely affect photographic silver halide materials, such as phenylsulfonyl acetates. Further details are provided in U.S. Pat. No. 4,123,274 (Knight et al.).

A range of concentration of the base-release agent or base precursor is useful in the described photothermographic materials. The optimum concentration of base-release agent or base precursor will depend upon such factors as the desired image, particular components in the photothermographic material, and processing conditions.

The use of "toners" or derivatives thereof that improve the image are highly desirable components of the thermographic and photothermographic materials of this invention. Toners are compounds that when added to the thermographic and photothermographic imaging layer shift the color of the developed silver image from yellowish-orange to brown-black or blue-black. Generally, one or more toners described herein are present in an amount of about 0.01% by weight to about 10%, and more preferably about 0.1% by weight to about 10% by weight, based on the total dry weight of the layer in which it is included. Toners may be incorporated in the photothermographic emulsion layer or in an adjacent layer.

Such compounds are well known materials in the photothermographic art, as shown in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (AGFA).

Examples of toners include, but are not limited to, phthalimide and N-hydroxyphthalimide, cyclic imides (such as succinimide), pyrazoline-5-ones, quinazolinone, 1-phenylurazole, 3-phenyl-2-pyrazoline-5-one, and 2,4-thiazolidinedione, naphthalimides (such as N-hydroxy-1,8-naphthalimide), cobalt complexes [such as hexaaminecobalt (3+) trifluoroacetate], mercaptans (such as 3-mercapto-1,2,4-triazole, 2,4-dimercaptopyrimidine, 3-mercapto-4,5-diphenyl-1,2,4-triazole and 2,5-dimercapto-1,3,4-thiadiazole), N-(amino-methyl)aryldicarboximides (such as (N,N-dimethylaminomethyl)phthalimide), and N-(dimethylaminomethyl)naphthalene-2,3-dicarboximide, a combination of blocked pyrazoles, isothiuronium derivatives, and certain photobleach agents [such as a combination of N,N'-hexamethylene-bis(1-carbamoyl-3,5-dimethyl-pyrazole), 1,8-(3,6-diazaoctane)bis(isothiuronium)trifluoroacetate, and 2-(tribromomethylsulfonyl benzothiazole)], merocyanine dyes {such as 3-ethyl-5-[(3-ethyl-2-benzothiazolinylidene)-1-methyl-ethylidene]-2-thio-2,4-o-azolidine-dione}, phthalazine and derivatives thereof [such as those described in U.S. Pat. No. 6,146,822 (Asanuma et al.)], phthalazinone and phthalazinone derivatives, or metal salts or these derivatives [such as 4-(1-naphthyl)phthalazinone, 6-chlorophthalazinone, 5,7-dimethoxyphthalazinone, and 2,3-dihydro-1,4-phthalazinedione], a combination of phthalazine (or derivative thereof) plus one or more phthalic acid derivatives (such as phthalic acid, 4-methylphthalic acid, 4-nitrophthalic acid, and tetrachlorophthalic anhydride), quinazolinediones, benzoxazine or naphthoxazine derivatives, rhodium complexes functioning not only as tone modifiers but also as sources of halide ion for silver halide formation in-situ [such as ammonium hexachlororhodate (3+), rhodium bromide, rhodium nitrate, and potassium hexachlororhodate (3+)], benzoxazine-2,4-diones (such as 1,3-benzoxazine-2,4-dione, 8-methyl-1,3-benzoxazine-2,4-dione and 6-nitro-1,3-benzoxazine-2,4-dione), pyrimidines and asym-triazines (such as 2,4-dihydroxypyrimidine, 2-hydroxy-4-aminopyrimidine and azauracil) and tetraazapentalene derivatives [such as 3,6-dimercapto-1,4-diphenyl-1H,4H-2,3a,5,6a-tetraazapentalene and 1,4-di-(o-chlorophenyl)-3,6-dimercapto-1H,4H-2,3a,5,6a-tetraazapentalene].

Phthalazines and phthalazine derivatives [such as those described in U.S. Pat. No. 6,146,822 (noted above), incorporated herein by reference], phthalazinone, and phthalazinone derivatives are particularly useful toners.

Additional useful toners are substituted and unsubstituted mercaptotriazoles as described for example in U.S. Pat. No. 3,832,186 (Masuda et al.), U.S. Pat. No. 6,165,704 (Miyake et al.), U.S. Pat. No. 5,149,620 (Simpson et al.), and copending and commonly assigned U.S. Ser. No. 10/193,443 (filed Jul. 11, 2002 by Lynch, Zou, and Ulrich) and U.S. Ser. No. 10/1 92,944 (filed Jul. 11, 2002 by Lynch, Ulrich, and Zou), all of which are incorporated herein by reference.

The photothermographic materials of this invention can also include one or more image stabilizing compounds that are usually incorporated in a "backside" layer. Such compounds can include, but are not limited to, phthalazinone and its derivatives, pyridazine and its derivatives, benzoxazine and benzoxazine derivatives, benzothiazine dione and its derivatives, and quinazoline dione and its derivatives, particularly as described in copending U.S. Ser. No. 10/041,386 (filed Jan. 8, 2002 by Kong). Other useful backside image stabilizers include, but are not limited to, anthracene compounds, coumarin compounds, benzophenone compounds, benzotriazole compounds, naphthalic acid imide compounds, pyrazoline compounds, or compounds described for example, in commonly assigned U.S. Pat. No. 6,465,162 (Kong et al.) and GB 1,565,043 (Fuji Photo). All of these patents and patent applications are incorporated herein by reference.

Binders

The photosensitive silver halide (when used), the non-photo-sensitive source of reducible silver ions, the reducing agent composition described above, and any other imaging layer additives used in the present invention are generally added to one or more binders that are either hydrophilic or hydrophobic. Thus, either aqueous or organic solvent-based formulations can be used to prepare the thermally developable materials of this invention. Mixtures of either or both types of binders can also be used. It is preferred that the binder be selected from hydrophobic polymeric materials such as, for example, natural and synthetic resins that are sufficiently polar to hold the other ingredients in solution or suspension.

Examples of typical hydrophobic binders include, but are not limited to, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable binders are polyvinyl butyral resins that are available as BUTVAR® B79 (Solutia, Inc.) and PIOLOFORM® BS-18 or PIOLOFORM® BL-16 (Wacker Chemical Company). Aqueous dispersions (or latexes) of hydrophobic binders such as those described in EP 0 911 691 A1 (Ishizaka et al.) may also be used.

Examples of useful hydrophilic binders include, but are not limited to, proteins and protein derivatives, gelatin and gelatin-like derivatives (hardened or unhardened, including alkali- and acid-treated gelatins, acetylated gelatin, oxidized gelatin, phthalated gelatin, and deionized gelatin), cellulosic materials such as hydroxymethyl cellulose and cellulosic esters, acrylamide/methacrylamide polymers, acrylic/methacrylic polymers polyvinyl pyrrolidones, polyvinyl alcohols, poly(vinyl lactams), polymers of sulfoalkyl acrylate or methacrylates, hydrolyzed polyvinyl acetates, polyacrylamides, polysaccharides (such as dextrans and starch ethers), and other synthetic or naturally occurring vehicles commonly known for use in aqueous-based photographic emulsions (see for example, *Research Disclosure*, item 38957, noted above). Cationic starches can be used as a peptizer for tabular silver halide grains as described in U.S. Pat. No. 5,620,840 (Maskasky) and U.S. Pat. No. 5,667,955 (Maskasky).

Hardeners for various binders may be present if desired. Useful hardeners are well known and include diisocyanate compounds as described for example, in EP 0 600 586 B1 (Philip et al.) and vinyl sulfone compounds as described in U.S. Pat. No. 6,143,487, and EP 0 640 589A1 (Gathmann et al.), aldehydes, and various other hardeners as described in U.S. Pat. No. 6,190,822 (Dickerson et al.). The hydrophilic binders used in the photothermographic materials are generally partially or fully hardened using any conventional hardener. Useful hardeners are well known and are described, for example, in T. H. James, *The Theory of the Photographic Process*, Fourth Edition, Eastman Kodak Company, Rochester, N.Y., 1977, Chapter 2, pp. 77–78.

Where the proportions and activities of the thermographic and photothermographic materials require a particular developing time and temperature, the binder(s) should be able to withstand those conditions. When a hydrophobic binder is used, it is preferred that the binder does not decompose or lose its structural integrity at 120° C. for 60 seconds. When a hydrophilic binder is used, it is preferred that the binder does not decompose or lose its structural integrity at 150° C. for 60 seconds. It is more preferred that it does not decompose or lose its structural integrity at 177° C. for 60 seconds.

The polymer binder(s) is used in an amount sufficient to carry the components dispersed therein. The effective range of amount of polymer can be appropriately determined by one skilled in the art. Preferably, a binder is used at a level of about 10% by weight to about 90% by weight, and more preferably at a level of about 20% by weight to about 70% by weight, based on the total dry weight of the layer in which it is included.

It is particularly useful in the thermally developable materials of this invention to use predominantly (more than 50% by weight of total binder weight) hydrophobic binders in both imaging and non-imaging layers on both sides of the support. In particular, the antistatic compositions described in more detail below are formulated and disposed on the support with one or more hydrophobic binders such as cellulose ester binders. Of these binders, cellulose acetate, cellulose acetate butyrate, and cellulose acetate propionate are preferred. Cellulose acetate butyrate is more preferred as the predominant binder for the conductive antistatic layers. In most preferred embodiments, cellulose acetate butyrate is the only binder in the conductive antistatic layers.

Support Materials

The thermographic and photothermographic materials of this invention comprise a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins (such as polyethylene and polypropylene), polycarbonates, and polystyrenes (and polymers of styrene derivatives). Preferred supports are composed of polymers having good heat stability, such as polyesters and polycarbonates. Polyethylene terephthalate film is a particularly preferred support. Various support materials are described, for example, in *Research Disclosure*, August 1979, item 18431. A method of making dimensionally stable polyester films is described in *Research Disclosure*, September 1999, item 42536.

It is also useful to use supports comprising dichroic mirror layers wherein the dichroic mirror layer reflects radiation at least having the predetermined range of wavelengths to the emulsion layer and transmits radiation, having wavelengths outside the predetermined range of wavelengths. Such dichroic supports are described in U.S. Pat. No. 5,795,708 (Boutet), incorporated herein by reference.

It is further useful to use transparent, multilayer, polymeric supports comprising numerous alternating layers of at least two different polymeric materials. Such multilayer polymeric supports preferably reflect at least 50% of actinic radiation in the range of wavelengths to which the photothermographic sensitive material is sensitive, and provide photothermographic materials having increased speed. Such transparent, multilayer, polymeric supports are. described in WO 02/21208 A1 (Simpson et al.), incorporated herein by reference.

Opaque supports can also be used, such as dyed polymeric films and resin-coated papers that are stable to high temperatures.

Support materials can contain various colorants, pigments, antihalation or acutance dyes if desired. Support materials may be treated using conventional procedures (such as corona discharge) to improve adhesion of overlying layers, or subbing or other adhesion-promoting layers can be used. Useful subbing layer formulations include those conventionally used for photographic materials such as vinylidene halide polymers.

Support materials may also be treated or annealed to reduce shrinkage and promote dimensional stability.

Photothermographic Formulations

An organic-based formulation for the thermographic and photothermographic emulsion layer(s) can be prepared by dissolving and dispersing the binder, the photocatalyst (when used), the source of non-photosensitive silver ions, the reducing composition, toner(s), and optional addenda in an organic solvent, such as toluene, 2-butanone (methyl ethyl ketone), acetone, or tetrahydrofuran.

Alternatively, the desired imaging components can be formulated with a hydrophilic binder (such as gelatin, a gelatin-derivative, or a latex) in water or water-organic solvent mixtures to provide aqueous-based coating formulations.

Thermographic and photothermographic materials of the invention can contain plasticizers and lubricants such as poly(alcohols) and diols of the type described in U.S. Pat. No. 2,960,404 (Milton et al.), fatty acids or esters such as those described in U.S. Pat. No. 2,588,765 (Robijns) and U.S. Pat. No. 3,121,060 (Duane), and silicone resins such as those described in GB 955,061 (DuPont). The materials can also contain matting agents such as starch, titanium dioxide, zinc oxide, silica, and polymeric beads including beads of the type described in U.S. Pat. No. 2,992,101 (Jelley et al.) and U.S. Pat. No. 2,701,245 (Lynn). Polymeric fluorinated surfactants may also be useful in one or more layers of the imaging materials for various purposes, such as improving coatability and optical density uniformity as described in U.S. Pat. No. 5,468,603 (Kub).

U.S. Pat. No. 6,436,616 (Geisler et al.) describes various means of modifying photothermographic materials to reduce what is known as the "woodgrain" effect, or uneven optical density. This effect can be reduced or eliminated by several means, including treatment of the support, adding matting agents to the topcoat, using acutance dyes in certain layers or other procedures described in the noted publication.

The thermographic and photothermographic materials of this invention can be constructed of one or more layers on a support. Single layer materials should contain the photocatalyst, the non-photosensitive source of reducible silver ions, the reducing composition, the binder, as well as optional materials such as toners, acutance dyes, coating aids and other adjuvants.

Two-layer constructions comprising a single imaging layer coating containing all the ingredients and a surface protective topcoat are generally found in the materials of this invention. However, two-layer constructions containing photocatalyst and non-photosensitive source of reducible silver ions in one imaging layer (usually the layer adjacent to the support) and the reducing composition and other ingredients in the second imaging layer or distributed between both layers are also envisioned.

Layers to promote adhesion of one layer to another in thermographic and photothermographic materials are also known, as described for example in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described for example in U.S. Pat. No. 5,928,857 (Geisler et al.).

Layers to reduce emissions from the film may also be present, including the polymeric barrier layers described in U.S. Pat. No. 6,352,819 (Kenney et al.), U.S. Pat. No. 6,352,820 (Bauer et al.), and U.S. Pat. No. 6,420,102 (Bauer et al.), all incorporated herein by reference.

Thermographic and photothermographic formulations described herein can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613. (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.), and GB 837,095 (Ilford). A typical coating gap for the emulsion layer can be from about 10 to about 750 $\mu$m, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

When the layers are coated simultaneously using various coating techniques, a "carrier" layer formulation comprising a single-phase mixture of the two or more polymers described above may be used. Such formulations are described in U.S. Pat. No. 6,355,405 (Ludemann et al.), incorporated herein by reference.

Mottle and other surface anomalies can be reduced in the materials of this invention by incorporation of a fluorinated polymer as described for example in U.S. Pat. No. 5,532,121 (Yonkoski et al.) or by using particular drying techniques as described, for example in U.S. Pat. No. 5,621,983 (Ludemann et al.).

Preferably, two or more layers are applied to a film support using slide coating. The first layer can be coated on top of the second layer while the second layer is still wet. The first and second fluids used to coat these layers can be the same or different solvents (or solvent mixtures).

While the first and second layers can be coated on one side of the film support, manufacturing methods can also include forming on the opposing or backside of said polymeric support, one or more additional layers, including an antihalation layer, an antistatic layer, or a layer containing a matting agent (such as silica), or a combination of such layers.

It is also contemplated that the photothermographic materials of this invention can include emulsion layers on both sides of the support and at least one infrared radiation absorbing heat-bleachable compositions as an antihalation underlayer beneath at least one emulsion layer.

To promote image sharpness, photothermographic materials according to the present invention can contain one or more layers containing acutance and/or antihalation dyes. These dyes are chosen to have absorption close to the exposure wavelength and are designed to absorb scattered light. One or more antihalation dyes may be incorporated into one or more antihalation layers according to known techniques, as an antihalation backing layer, as an antihalation underlayer, or as an antihalation overcoat. Additionally, one or more acutance dyes may be incorporated into one or more frontside layers such as the photothermographic emulsion layer, primer layer, underlayer, or topcoat layer according to known techniques. It is preferred that the photothermographic materials of this invention contain an antihalation coating on the support opposite to the side on which the emulsion and topcoat layers are coated.

Dyes useful as antihalation and acutance dyes include squaraine dyes described in U.S. Pat. No. 5,380,635 (Gomez et al.), U.S. Pat. No. 6,063,560 (Suzuki et al.), and EP 1 083

459 A1 (Kimura), the indolenine dyes described in EP 0 342 810 A1 (Leichter), and the cyanine dyes described in copending and commonly assigned U.S. Ser. No. 10/011,892 (filed Dec. 5, 2001 by Hunt, Kong, Ramsden, and LaBelle). All of the above are incorporated herein by reference.

It is also useful in the present invention to employ compositions including acutance or antihalation dyes that will decolorize or bleach with heat during processing. Dyes and constructions employing these types of dyes are described in, for example, U.S. Pat. No. 5,135,842 (Kitchin et al.), U.S. Pat. No. 5,266,452 (Kitchin et al.), U.S. Pat. No. 5,314,795 (Helland et al.), U.S. Pat. No. 6,306,566, (Sakurada et al.), U.S. Published Application 2001-0001704 (Sakurada et al.), JP Kokai 2001-142175 (Hanyu et al.), and. JP Kokai 2001-183770 (Hanye et al.). Also useful are bleaching compositions described in JP Kokai 11-302550 (Fujiwara), JP Kokai 2001-109101 (Adachi), JP Kokai 2001-51371 (Yabuki et al.), and JP Kokai 2000-029168 (Noro). All of these publications are incorporated herein by reference.

Particularly useful heat-bleachable backside antihalation compositions can include an infrared radiation absorbing compound such as an oxonol dyes and various other compounds used in combination with a hexaarylbiimidazole (also known as a "HABI"), or mixtures thereof. Such HABI compounds are well known in the art, such as U.S. Pat. No. 4,196,002 (Levinson et al.), U.S. Pat. No. 5,652,091 (Perry et al.), and U.S. Pat. No. 5,672,562 (Perry et al.), all incorporated herein by reference. Examples of such heat-bleachable compositions are described for example in commonly assigned U.S. Pat. No. 6,455,210 (Irving et al.), U.S. Pat. No. 6,558,880 (Goswami et al.) and U.S. Pat. No. 6,514,677 (Ramsden et al.) all incorporated herein by reference.

Under practical conditions of use, the compositions are heated to provide bleaching at a temperature of at least 90° C. for at least 0.5 seconds. Preferably, bleaching is carried out at a temperature of from about 100° C. to about 200° C. for from about 5 to about 20 seconds. Most preferred bleaching is carried out within 20 seconds at a temperature of from about 110° C. to about 130° C.

In preferred embodiments, the thermally developable materials of this invention include a surface protective layer on the same side of the support as the one or more thermally-developable layers, an antihalation layer on the opposite side of the support, or both a surface protective layer and an antihalation layer on their respective sides of the support.

Antistatic Compositions/Layers

The thermally developable materials of this invention generally include one or more antistatic or conducting layers. Such layers may contain conventional antistatic agents known in the art for this purpose such as soluble salts (for example, chlorides or nitrates), evaporated metal layers, or ionic polymers such as those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy), electroconductive underlayers such as those described in U.S. Pat. No. 5,310,640 (Markin et al.), electronically-conductive metal antimonate particles such as those described in U.S. Pat. No. 5,368,995 (Christian et al.), and electrically-conductive metal-containing particles dispersed in a polymeric binder such as those described in EP 0 678 776 A1 (Melpolder et al.), and the solutions and dispersions of polythiophene compounds described in U.S. Pat. No. 5,300,575 (Jonas et al.).

In some embodiments, a desirable component of antistatic compositions includes one or more fluorochemicals each of which is a reaction product of $R_f$—$CH_2CH_2$—$SO_3H$ with an amine wherein $R_f$ comprises 4 or more fully fluorinated carbon atoms. In preferred embodiments, $R_f$ comprises 4 or more even-numbered fully fluorinated carbon atoms. These antistatic compositions are described in more detail in copending and commonly assigned U.S. Ser. No. 10/107,551 (filed Mar. 27, 2002 by Sakizadeh, LaBelle, Orem, and Bhave) that is incorporated herein by reference.

Imaging/Development

The thermally developable materials of the present invention can be imaged in any suitable manner consistent with the type of material using any suitable imaging source (typically some type of radiation or electronic signal for photothermographic materials and a source of thermal energy for thermographic materials). In some embodiments, the materials are sensitive to radiation in the range of from about at least 300 nm to about 1400 nm, and preferably from about 300 nm to about 850 nm.

Imaging can be achieved by exposing the photothermographic materials of this invention to a suitable source of radiation to which they are sensitive, including ultraviolet radiation, visible light, near infrared radiation and infrared radiation to provide a latent image. Suitable exposure means are well known and include sources of radiation, including: incandescent or fluorescent lamps, xenon flash lamps, lasers, laser diodes, light emitting diodes, infrared lasers, infrared laser diodes, infrared light-emitting diodes, infrared lamps, or any other ultraviolet, visible, or infrared radiation source readily apparent to one skilled in the art, and others described in the art, such as in *Research Disclosure*, September, 1996, item 38957. Particularly useful infrared exposure means include laser diodes, including laser diodes that are modulated to increase imaging efficiency using what is known as multi-longitudinal exposure techniques as described in U.S. Pat. No. 5,780,207 (Mohapatra et al.). Other exposure techniques are described in U.S. Pat. No. 5,493,327 (McCallum et al.).

Thermal development conditions will vary, depending on the construction used but will typically involve heating the imagewise exposed material at a suitably elevated temperature. Thus, the latent image can be developed by heating the exposed material at a moderately elevated temperature of, for example, from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means such as a hot plate, a steam iron, a hot roller or a heating bath.

In some methods, the development is carried out in two steps. Thermal development takes place at a higher temperature for a shorter time (for example at about 150° C. for up to 10 seconds), followed by thermal diffusion at a lower temperature (for example at about 80° C.) in the presence of a transfer solvent.

When imaging thermographic materials of this invention, the image may be "written" simultaneously with development at a suitable temperature using a thermal stylus, a thermal print-head, or a laser, or by heating while in contact with a heat-absorbing material. The thermographic materials may include a dye (such as an IR-absorbing dye) to facilitate direct development by exposure to laser radiation. The dye converts absorbed radiation to heat.

Use as a Photomask

The thermographic and photothermographic materials of the present invention are sufficiently transmissive in the range of from about 350 to about 450 nm in non-imaged areas to allow their use in a method where there is a subsequent exposure of an ultraviolet or short wavelength visible radiation sensitive imageable medium. For example, imaging the materials and subsequent development affords a visible image. The heat-developed thermographic and photothermographic materials absorbs ultraviolet or short wavelength visible radiation in the areas where there is a visible image and transmit ultraviolet or short wavelength visible radiation where there is no visible image. The heat-developed materials may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed photothermographic material provides an image in the imageable material. This method is particularly useful where the imageable medium comprises a printing plate and the photothermographic material serves as an imagesetting film.

The present invention also provides a method for the formation of a visible image (usually a black-and-white image) by first exposing to electromagnetic radiation and thereafter heating the inventive photothermographic material. In one embodiment, the present invention provides a method comprising:

A) imagewise exposing the photothermographic material of this invention to electromagnetic radiation to which the photocatalyst (for example, a photosensitive silver halide) of the material is sensitive, to form a latent image, and B) simultaneously or sequentially, heating the exposed material to develop the latent image into a visible image.

The photothermographic material may be exposed in step A using any source of radiation, to which it is sensitive, including: ultraviolet radiation, visible light, infrared radiation or any other infrared radiation source readily apparent to one skilled in the art.

The present invention also provides a method for the formation of a visible image (usually a black-and-white image) by thermal imaging and development of the inventive thermographic material. In one embodiment, the present invention provides a method comprising:

A) thermal imaging of the thermographic material of this invention to form a visible image.

This visible image prepared from either a thermographic or photothermographic material can also be used as a mask for exposure of other photosensitive imageable materials, such as graphic arts films, proofing films, printing plates and circuit board films, that are sensitive to suitable imaging radiation (for example, UV radiation). This can be done by imaging an imageable material (such as a photopolymer, a diazo material, a photoresist, or a photosensitive printing plate) through the heat-developed thermographic or photothermographic material. Thus, in some other embodiments wherein the thermographic or photothermographic material comprises a transparent support, the image-forming method further comprises:

C) positioning the exposed and heat-developed thermographic or photothermographic material between a source of imaging radiation and an imageable material that is sensitive to the imaging radiation, and D) exposing the imageable material to the imaging radiation through the visible image in the exposed and heat-developed photothermographic material to provide an image in the imageable material.

Imaging Assemblies

To further increase photospeed, the X-radiation sensitive photothermographic materials of this invention may be used in combination with one or more phosphor intensifying screens and/or metal screens in what is known as "imaging assemblies." An intensifying screen absorbs X-radiation and emits longer wavelength electromagnetic radiation that the photosensitive silver halide more readily absorbs. Double-sided X-radiation sensitive photothermographic materials (that is, materials having one or more thermally developable imaging layers on both sides of the support) are preferably used in combination with two intensifying screens, one screen in the "front" and one screen in the "back" of the material.

Such imaging assemblies are composed of a photothermographic material as defined herein (particularly one sensitive to X-radiation or visible light) and one or more phosphor intensifying screens adjacent the front and/or back of the material. These screens are typically designed to absorb X-rays and to emit electromagnetic radiation having a wavelength greater than 300 nm.

There are a wide variety of phosphors known in the art that can be formulated into phosphor intensifying screens, including but not limited to, the phosphors described in *Research Disclosure*, August 1979, Item 18431, Section IX, X-ray Screens/Phosphors, U.S. Pat. No. 2,303,942 (Wynd et al.), U.S. Pat. No. 3,778,615 (Luckey), U.S. Pat. No. 4,032,471 (Luckey), U.S. Pat. No. 4,225,653 (Brixner et al.), U.S. Pat. No. 3,418,246 (Royce), U.S. Pat. No. 3,428,247 (Yocon), U.S. Pat. No. 3,725,704 (Buchanan et al.), U.S. Pat. No. 2,725,704 (Swindells), U.S. Pat. No. 3,617,743 (Rabatin), U.S. Pat. No. 3,974,389 (Ferri et al.), U.S. Pat. No. 3,591,516 (Rabatin), U.S. Pat. No. 3,607,770 (Rabatin), U.S. Pat. No. 3,666,676 (Rabatin), U.S. Pat. No. 3,795,814 (Rabatin), U.S. Pat. No. 4,405,691 (Yale), U.S. Pat. No. 4,311,487 (Luckey et al.), U.S. Pat. No. 4,387,141 (Patten), U.S. Pat. No. 5,021,327 (Bunch et al.), U.S. Pat. No. 4,865,944 (Roberts et al.), U.S. Pat. No. 4,994,355 (Dickerson et al.), U.S. Pat. No. 4,997,750 (Dickerson et al.), U.S. Pat. No. 5,064,729 (Zegarski), U.S. Pat. No. 5,108,881 (Dickerson et al.), U.S. Pat. No. 5,250,366 (Nakajima et al.), U.S. Pat. No. 5,871,892 (Dickerson et al.), EP-A-0 491,1 i6 (Benzo et al.), U.S. Pat. No. 4,988,880 (Bryan et al.), U.S. Pat. No. 4,988,881 (Bryan et al.), U.S. Pat. No. 4,994,205 (Bryan et al.), U.S. Pat. No. 5,095,218 (Bryan et al.), U.S. Pat. No. 5,112,700 (Lambert et al.), U.S. Pat. No. 5,124,072 (Dole et al.), U.S. Pat. No. 5,336,893 (Smith et al.), U.S. Pat. No. 4,835,397 (Arakawa et al.), U.S. Pat. No. 5,381,015 (Dooms), U.S. Pat. No. 5,464,568 (Bringley et al.), U.S. Pat. No. 4,226,653 (Brixner), U.S. Pat. No. 5,064,729 (Zegarski), U.S. Pat. No. 5,250,366 (Nakajima et al.), and U.S. Pat. No. 5,626,957 (Benso et al.), U.S. Pat. No. 4,368,390 (Takahashi et al.), and U.S. Pat. No. 5,227,253 (Takasu et al.), the disclosures of which are all incorporated herein by reference for their teaching of phosphors and formulation of phosphor intensifying screens.

Phosphor intensifying screens can take any convenient form providing they meet all of the usual requirements for use in radiographic imaging, as described for example in U.S. Pat. No. 5,021,327 (Bunch et al.), incorporated herein by reference. A variety of such screens are commercially available from several sources including by not limited to, LANEX®, X-SIGHT® and InSight® Skeletal screens available from Eastman Kodak Company. The front and back screens can be appropriately chosen depending upon the type of emissions desired, the photicity desired, emulsion speeds, and % crossover. A metal (such as copper or lead) screen can also be included if desired.

Imaging assemblies can be prepared by arranging a suitable photothermographic material in association with one or more phosphor intensifying screens, and one or more metal screens in a suitable holder (often known as a cassette), and appropriately packaging them for transport and imaging uses.

Photothermographic materials can also be prepared incorporating phosphors within the imaging layers (or adjacent layers) to provide an increase in sensitivity to X-radiation as well as to provide sharp, high resolution images, with a low level of "noise" and image fog. Photothermographic films incorporating phosphors within the imaging layers (or adjacent layers) can also be placed in contact with X-ray screens to provide a further increase in sensitivity to X-radiation. Such materials are described in U.S. Pat. No. 6,440,639 (Simpson et al.), incorporated herein by reference.

Constructions and assemblies useful in industrial radiography include, for example, U.S. Pat. No. 4,480,024 (Lyons et al), U.S. Pat. No. 5,900,357 (Feumi-Jantou et al.), and EP 1 350 883 (Pesce et al.).

The following examples are provided to illustrate the practice of this invention, and are not intended to be limiting in any manner. The examples provide exemplary synthetic procedures and preparatory procedures using the speed and contrast increasing compounds within the scope of the present invention

MATERIALS AND METHODS FOR THE EXAMPLES

All materials used in the following examples are readily available from standard commercial sources, such as Aldrich Chemical Co. (Milwaukee Wis.) unless otherwise specified. All percentages are by weight unless otherwise indicated. The following additional terms and materials were used.

ACRYLOID A-21 or PARALOID™ A-21 is an acrylic copolymer available from Rohm and Haas, Philadelphia, Pa.

ALBACAR 5970 is a 1.9 μm precipitated calcium carbonate. It is available from Specialty Minerals, Inc. (Bethlehem, Pa.).

BUTVAR B-79 is a polyvinyl butyral resin available from Solutia Company, St. Louis, Mo.

CAB 171–15 S is a cellulose acetate butyrate resin available from Eastman Chemicals Co.

Dow Corning 550 (DC 550) is a trimethyl terminated dimethyl, phenylmethyl siloxane available from Dow Corning (Midland, Mich.)

DESMODUR N3300 is an aliphatic hexamethylene diisocyanate available from Bayer Chemicals, Pittsburgh, Pa.

MEK is methyl ethyl ketone (or 2-butanone).

PERMANAX WSO is 1,1-bis(2-hydroxy-3,5-dimethylphenyl)-3,5,5-trimethylhexane [CAS RN=7292-14-0] and is available from St-Jean PhotoChemicals, Inc. (Quebec). It is a bis-phenol reducing agent (that is a type of hindered phenol reducing agent) for the non-photosensitive reducible source of silver. It is also known as NONOX.

PIOLOFORM® BL-16 and PIOLOFORM® BN-18 are polyvinyl butyral resins available from Wacker Polymer Systems (Adrian, Mich.).

SERVOXYL® VPAZ 100 is a mixture of monolauryl and dilauryl esters of phosphoric acid available from Sasol North America (Houston, Tex.). 2H-1,3-Benzoxazine-2,4(3H)-dione is available from Aldrich Chemical Company and has the structure shown below.

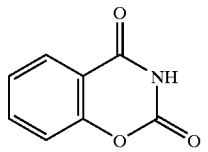

Chemical Sensitizer-A has the structure shown below.

CS-A

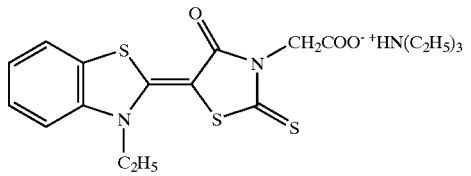

Sensitizing Dye A has the structure show below.

SSD-A

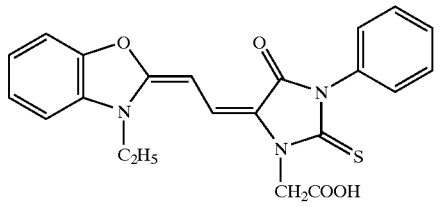

Vinyl Sulfone-1 (VS-1) is described in U.S. Pat. No. 6,143,487 (Philip et al.) and the structure shown below.

VS-1

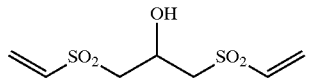

Antifoggant A is 2-(tribromomethylsulfonyl)quinoline and has the structure shown below.

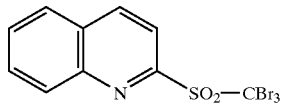

Antifoggant B is ethyl-2-cyano-3-oxobutanoate. It is described in U.S. Pat. No. 5,686,228 and has the structure shown below.

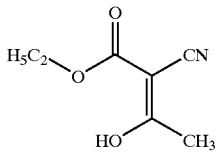

Backcoat Dye BC-1 is cyclobutenediylium, 1,3-bis[2,3-dihydro-2,2-bis[[1-oxohexyl)oxy]methyl]-1H-perimidin-4-yl]-2,4-dihydroxy-, bis(inner salt). It is believed to have the structure shown below.

BC-1

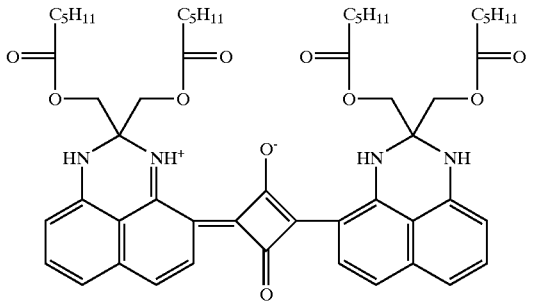

Example 1

Photothermographic Material

A pre-formed silver bromoiodide, silver carboxylate soap dispersion was prepared using a 0.05 μm iridium- and copper-doped core-shell silver halide grain emulsion prepared as described in U.S. Pat. No. 5,939,249 (noted above).

A photothermographic emulsion was prepared from this dispersion in a manner similar to that described in U.S. Pat. No. 6,083,681 (noted above) but using the materials and amounts shown below.

Photothermographic Emulsion Formulation

To 163 g of this silver carboxylate dispersion at 28.5% solids were added:

| | |
|---|---|
| MEK | 16.60 g |
| CS-A | 0.02 g in 5.0 g methanol |
| Pyridinium hydrobromide perbromide | 0.20 g in 1.58 g methanol |
| Calcium bromide | 0.15 g in 1.19 g methanol |
| Dye premix | (see below) |
| BUTVAR B-79 polyvinyl butyral | 20 g |
| Antifoggant A | 0.6 g in 10 g MEK |
| DESMODUR N3300 | 0.63 g in 1.50 g MEK |
| Tetrachlorophthalic acid | 0.35 g in 2.0 g MEK |
| Phthalazine | 1.00 g in 5.0 g MEK |
| 4-Methylphthalic acid | 0.45 g in 4.0 g MEK |
| Dye Premix Formulation: | |
| Sensitizing dye A | 0.020 g |
| Chlorobenzoyl benzoic acid | 1.42 g |
| Methanol | 5.0 g |

To 28.8 g of the photothermographic emulsion formulation was added $8.7\times10^{-4}$ moles of PERMANAX WSO, or $6.1\times10^{-4}$ moles co-developer (CD compound), or a combination of $8.7\times10^{-4}$ moles of PERMANAX WSO and $6.1\times10^{-4}$ moles of co-developer.

A protective topcoat for the photothermographic emulsion layer was prepared as follows:

| Topcoat Formulation | |
|---|---|
| ACRYLOID A-21 | 0.92 g |
| CAB 171-15S | 23.9 g |

-continued

| Topcoat Formulation | |
|---|---|
| MEK | 294 g |
| VS-1 | 0.60 g of 80.6% pure |
| Benzotriazole | 2.56 g |
| Antifoggant B | 0.19 g |

The photothermographic emulsion and topcoat formulations were coated under safelight conditions onto a 7 mil (178 μm) blue tinted polyethylene terephthalate support using a conventional dual-knife coating machine. Coating and drying were carried out also as described in U.S. Pat. No. 6,083,681. Prior to coating, the support was provided with a backside coating containing Backcoat Dye BC-1 in CAB 171-15S resin.

Samples of the resulting photothermographic materials were imagewise exposed for $10^{-3}$ seconds using a conventional EG&G Flash sensitometer equipped with a P-31 filter and developed using a heated roll processor at 123° C. for the time period indicated below.

Densitometry measurements were made on a custom built computer-scanned densitometer using a filter appropriate to the sensitivity of the photothermographic material and are believed to be comparable to measurements from commercially available densitometers.

$D_{min}$ is the density of the non-exposed areas after development.

$D_{max}$ is the maximum density of film in the imaged area.

Speed-2 ("SP-2") is Log1/E+4 corresponding to the density value of 1.00 above $D_{min}$ where E is the exposure in ergs/cm$^2$.

Average Contrast-1 ("AC-1") is the absolute value of the slope of the line joining the density points of 0.60 and 2.00 above $D_{min}$.

Average Contrast-2 ("AC-2") is the absolute value of the slope of the line joining the density points of 1.00 and 2.40 above $D_{min}$.

The sensitometric data of the resulting photothermographic material, shown below in TABLE I, demonstrate that addition of blocked phenylene diamine co-developers results in an increase in speed and contrast when incorporated into photothermographic materials. It should also be noted that phenylene diamine compound CD-1 appears to show the best increase in speed and contrast coupled with a small increase in $D_{min}$, and is a preferred compound. The notation "NM" indicates that the value could not be measured.

TABLE I

| Sample | Developer | Process Time (sec) | $D_{min}$ | SPD-2 | AC-1 | AC-2 |
|---|---|---|---|---|---|---|
| 1-1 | PERMANAX WSO | 15 | 0.20 | 1.29 | NM | NM |
| 1-2 | CD-1 | 15 | 0.96 | 2.10 | NM | NM |
| 1-3 | PERMANAX WSO + CD-1 | 15 | 0.24 | 2.36 | 10.20 | 11.55 |
| 1-4 | CD-2 | 15 | 0.21 | NM | NM | NM |
| 1-5 | PERMANAX WSO + CD-2 | 15 | 0.21 | 1.69 | 2.97 | 2.61 |
| 1-6 | PERMANAX WSO + CD-2 | 25 | 0.22 | 1.92 | 3.48 | 3.25 |
| 1-7 | CD-6 | 15 | 0.21 | NM | NM | NM |
| 1-8 | PERMANAX WSO + CD-6 | 15 | 0.22 | 1.63 | 3.41 | 3.17 |

TABLE I-continued

| Sample | Developer | Process Time (sec) | $D_{min}$ | SPD-2 | AC-1 | AC-2 |
|---|---|---|---|---|---|---|
| 1-9 | PERMANAX WSO + CD-6 | 25 | 0.25 | 1.84 | 4.08 | 3.74 |

Example 2

Photothermographic Material

To 28.8 g of the photothermographic emulsion formulation prepared in Example 1 was added $1.7\times10^{-3}$ moles of PERMANAX WSO or $6.1\times10^{-4}$ moles of co-developer or a combination of $1.7\times10^{-3}$ moles of PERMANAX WSO and $6.1\times10^{-4}$ moles of co-developer.

Samples were prepared, coated, dried, and imaged as described in Example 1. The sensitometric data, shown below in TABLE II, demonstrate that addition of blocked phenylene diamine co-developers results in an increase in speed and contrast when incorporated into photothermographic materials. It should also be noted that phenylene diamine compounds CD-7 and CD-8 are more reactive co-developers than compound CD-1.

TABLE II

| Sample | Developer | Process Time (sec) | $D_{min}$ | SPD-2 | AC-1 | AC-2 |
|---|---|---|---|---|---|---|
| 2-1 | PERMANAX WSO | 15 | 0.21 | 2.14 | 3.71 | 3.55 |
| 2-2 | CD-1 | 15 | 0.30 | 2.51 | NM | NM |
| 2-3 | PERMANAX WSO + CD-1 | 15 | 0.25 | 2.62 | 11.21 | 13.69 |
| 2-4 | PERMANAX | 10 | 0.20 | 1.84 | NM | NM |
| 2-5 | CD-7 | 10 | 0.88 | NM | NM | NM |
| 2-6 | PERMANAX WSO + CD-7 | 10 | 0.35 | 2.93 | 8.00 | 10.51 |
| 2-7 | PERMANAX | 5 | 0.20 | NM | NM | NM |
| 2-8 | CD-7 | 5 | 0.21 | NM | NM | NM |
| 2-9 | PERMANAX WSO + CD-7 | 5 | 0.24 | 2.34 | 5.24 | 4.62 |

NM = Could not be measured

Example 3

Photothermographic Material

This example shows the effects of various concentrations of phenylene diamine blocked co-developers on the sensitometric properties of photothermographic materials.

To 28.8 g of the photothermographic emulsion formulation prepared in Example 1 were added various amounts of PERMANAX WSO, co-developer, or a combination of PERMANAX WSO and co-developer.

Samples were prepared, coated, dried, and imaged as described in Example 1. The sensitometric data, shown below in TABLE III, demonstrate that a combination of co-developers with the hindered phenol reducing agent PERMANAX provides photothermographic materials with increased speed and contrast.

TABLE III

| Sample | Developer Amount | Process Time (sec) | $D_{min}$ | SPD-2 | AC-1 | AC-2 |
|---|---|---|---|---|---|---|
| 3-1 | PERMANAX WSO $8.7\times10^{-4}$ moles | 15 | 0.20 | 1.14 | NM | NM |
| 3-2 | CD-9 $6.1\times10^{-4}$ moles | 15 | 0.23 | NM | NM | NM |
| 3-3 | PERMANAX WSO $8.7\times10^{-4}$ moles + CD-9 $6.1\times10^{-4}$ moles | 15 | 0.24 | 1.95 | NM | NM |

NM = Could not be measured

Example 4

Thermographic Material

Silver Soap Homogenate Formulation:

A silver soap thermographic homogenate formulation was prepared with the following components.

| | |
|---|---|
| MEK | 75.5% |
| Silver Behenate | 24.0% |
| PIOLOFORM ® BL-16 | 0.5% |

The materials were mixed and homogenized by passing twice through a homogenizer at 5000 psi (352 kg/cm$^2$). The materials were cooled between the two passes.

Thermographic Emulsion Formulation:

To 69 g of this silver behenate homogenate at 24.5% solids was added 162.26 g of MEK. Stirring for 15 minutes was followed by addition of 2.5 g of 2H-1,3-benzoxazine-2,4(3H)-dione. Stirring for 30 minutes was followed by addition of 66.24 g of Butvar B-79. The reaction was stirred for an additional 60 minutes to afford 300 g of thermographic emulsion.

The following developers were added to 50 g aliquots of the above solution and mixed for 30 minutes to provide the thermographic emulsion. Sample 4-1 contained no thermally releasable phenylene diamine developer. It served as a control.

TABLE IV

| Sample | Developer/Amount | Amount | Total mmol of Developers |
|---|---|---|---|
| 4-1 | 2,5-Dihydroxybenzoic acid + 2,3-Dihydroxybenzoic acid | 0.67 g 0.17 g | 5.4 |
| 4-2 | 2,5-Dihydroxybenzoic acid + 2,3-Dihydroxybenzoic acid + CD-1 | 0.17 g 0.04 g 0.25 g | 2.31 |
| 4-3 | 2,5-Dihydroxybenzoic acid + 2,3-Dihydroxybenzoic acid + CD-1 | 0.17 g 0.04 g 0.50 g | 3.26 |
| 4-4 | 2,5-Dihydroxybenzoic acid + 2,3-Dihydroxybenzoic acid + CD-1 | 0.17 g 0.04 g 0.75 g | 4.21 |

Topcoat Formulation:

A protective topcoat for the thermographic emulsion layer was prepared as follows:

| | |
|---|---|
| MEK | 2236.41 g |
| CAB 171-15S | 273.78 g |
| PARALOID A-21 | 37.26 g |
| DC 550 | 44.55 g |
| SERVOXYL ® VPAZ 100 | 5.94 g in 75.60 g MEK |
| ALBACAR 5970 | 2.0 g in 25 g MEK |

The resulting topcoat solution contained 13% solids and had a viscosity of 400 cps.

The thermographic emulsion and topcoat formulations were coated onto a 7 mil (178 am) blue tinted polyethylene terephthalate support using a conventional dual knife coating machine. Samples were dried in an oven at 85° C. for 7 minutes.

Samples of the resulting thermographic materials were imaged using an AGFA DryStar™ Model 2000 printer. All samples gave a black image.

The sensitometric data, shown below in TABLE V demonstrate that a developer system incorporating a thermally releasable phenylene diamine developer, shows higher maximum density than a similarly prepared sample not incorporating such a developer.

TABLE V

| Sample | Silver Coating Weight ($g/m^2$) | Topcoat Coating Weight ($g/m^2$) | $D_{min}$ | $D_{max}$ |
|---|---|---|---|---|
| 4-1 | 1.04 | 4 | 0.15 | 3.26 |
| 4-2 | 1.05 | 4 | 0.16 | 3.60 |
| 4-3 | 0.99 | 4 | 0.17 | 3.96 |
| 4-4 | 1.06 | 4 | 0.17 | 3.81 |

The invention has been described in detail with particular reference to certain preferred embodiments thereof, but it will be understood that variations and modifications can be effected within the spirit and scope of the invention.

We claim:

1. A black-and-white thermally developable material that comprises a support having thereon one or more thermally developable imaging layers comprising:

a binder, a non-photosensitive source of reducible silver ions, and a reducing agent composition for said non-photosensitive source of reducible silver ions, said reducing agent composition comprising: a) a hindered phenol reducing agent, an aromatic di- or tri-hydroxy compound, or mixtures thereof, and b) a thermally-releasable p-phenylenediamine co-developer that is represented by the following Structure 1:

R—NH-BLOCK (I)

wherein R—NH— is a p-phenylenediamine group and BLOCK is a blocking group that is cleaved upon exposure to at least 120° C. for at least 5 seconds and comprises one or more of the following thermally cleavable groups: —CONH—, —COO—, —$CONHSO_2$—, —$PO_3$—, —$SO_2$—, —$COCH_2NHCO$—, or —COS—, and BLOCK is directly linked to R—NH— through one of said thermally cleavable groups.

2. The thermally developable material of claim 1 further comprising a photosensitive silver halide in reactive association with said non-photosensitive source of reducible silver ions.

3. The thermally developable material of claim 1 wherein said hindered phenol reducing agent comprises a bis-phenol reducing agent.

4. The thermally developable material of claim 1 wherein said di- or tri-hydroxy compound comprises a catechol reducing agent having no more than two hydroxy groups in an ortho-relationship.

5. The thermally developable material of claim 1 wherein said thermally-releasable p-phenylenediamine co-developer is represented by the following Structure II:

(II)

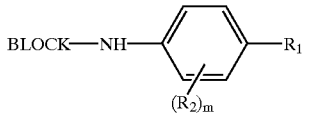

wherein $R_1$ is an amino group, $R_2$ is hydrogen, or a substituted or unsubstituted alkyl, alkenyl, alkoxy, thioalkyl, or halo group, m is 0, 1, or 2, and BLOCK is any of the following groups BLOCK-1 through BLOCK-8:

| | |
|---|---|
| BLOCK-1 | —CONH—$R_3$ (ureido group) |
| BLOCK-2 | —COO—$R_3$ (carbamoyl group) |
| BLOCK-3 | —$CONHSO_2$—$R_3$ |
| BLOCK-4 | 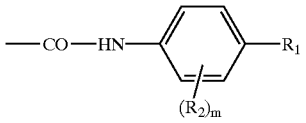  |
| BLOCK-5 | —$SO_2$—$R_3$ |
| BLOCK-6 | —PO—$(OR_3)_2$ (phosphate group) |
| BLOCK-7 | —$COCH_2NHCO$—$R_3$ |
| BLOCK-8 | —COS—$R_3$ |

wherein $R_3$ is substituted or unsubstituted alkyl, alkenyl, aryl, cycloalkyl, or heterocyclyl group.

6. The thermally developable material of claim 5 wherein BLOCK is BLOCK-1, BLOCK-2, or BLOCK-4.

7. The thermally developable material of claim 1 wherein said thermally-releasable p-phenylenediamine co-developer is one or more of the following compounds CD-1 through CD-15:

(CD-1)

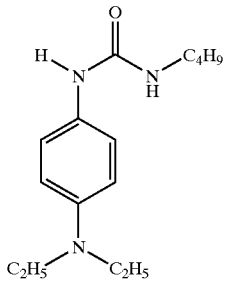

-continued
(CD-2)
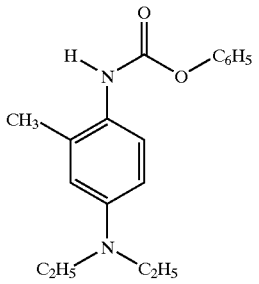
(CD-3)
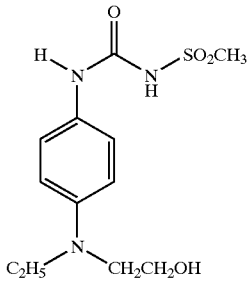
(CD-4)
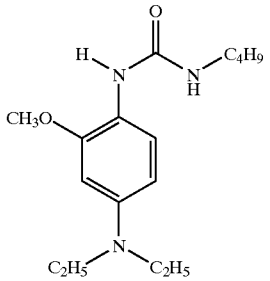
(CD-5)
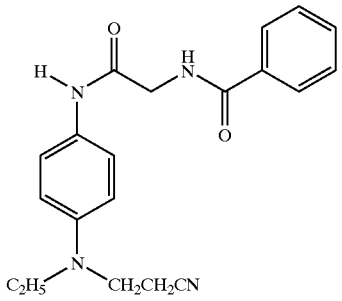
(CD-6)
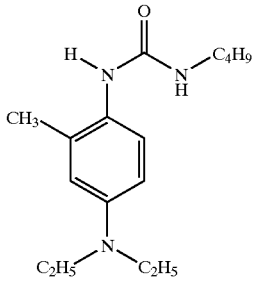
-continued
(CD-7)
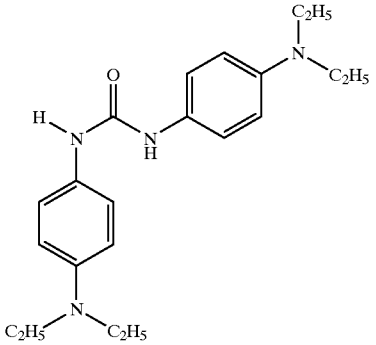
(CD-8)
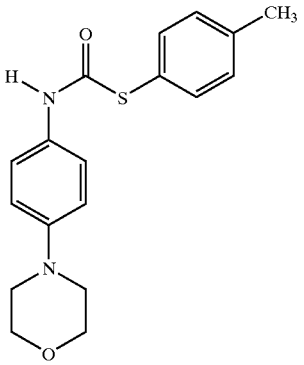
(CD-9)
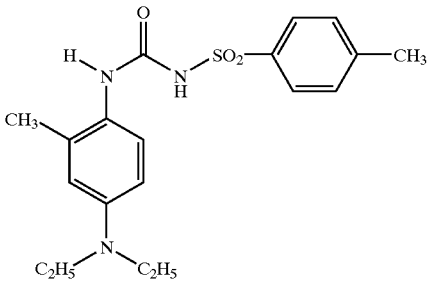
(CD-10)
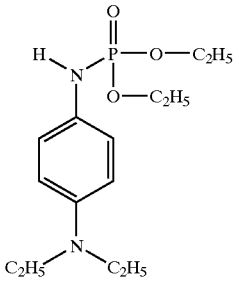
(CD-11)
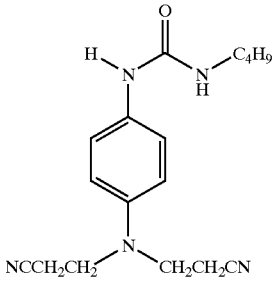

-continued (CD-12)

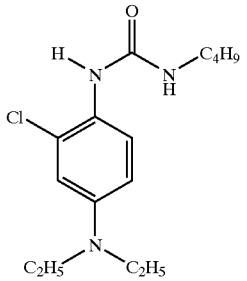

(CD-13)

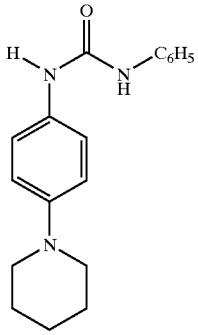

(CD-14)

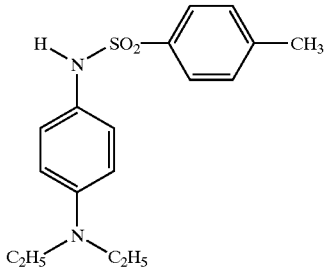

(CD-15)

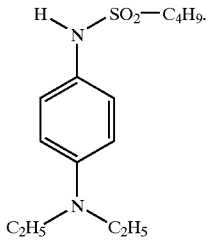

8. The thermally developable material of claim 1 wherein said binder is a hydrophobic binder.

9. The thermally developable material of claim 1 wherein said hindered phenol reducing agent and said thermally-releasable p-phenylenediamine co-developer are present in the same imaging layer.

10. The thermally developable material of claim 1 wherein the molar ratio of said hindered phenol reducing agent, aromatic di- or tri-hydroxy compound, or mixture thereof, to said thermally-releasable p-phenylenediamine co-developer is at least 10:1.

11. The thermally developable material of claim 1 wherein the molar ratio of said hindered phenol reducing agent, aromatic di- or tri-hydroxy compound, or mixture thereof, to said thermally-releasable p-phenylenediamine co-developer is from about 5:1 to about 1:1, and the amount of said hindered phenol reducing agent is at least 0.4 g/m$^2$ and the amount of said thermally-releasable p-phenylenediamine co-developer is at least 0.2 g/m$^2$.

12. The thermally developable material of claim 1 wherein said non-photosensitive source of reducible silver ions is a silver fatty acid carboxylate having 10 to 30 carbon atoms in the fatty acid or a mixture of said silver carboxylates, at least one of which is silver behenate.

13. The thermally developable material of claim 1 further comprising a protective layer over said one or more thermally-developable imaging layers.

14. A black-and-white photothermographic material that comprises a support having thereon one or more thermally developable imaging layers comprising:

a binder, a photosensitive silver halide, a non-photosensitive source of reducible silver ions, and a reducing agent composition for said non-photosensitive source reducible silver ions, said reducing agent composition comprising: a) a hindered phenol reducing agent, and b) a thermally-releasable p-phenylenediamine co-developer, that is represented by the following Structure 1:

R—NH-BLOCK (I)

wherein R—NH— is a p-phenylenediamine group and BLOCK is a blocking group that is cleaved upon exposure to at least 120° C. for at least 5 seconds and comprises one or more of the following thermally cleavable groups: —CONH—, —COO—, —CONHSO$_2$—, —PO$_3$—, —SO2—, —COCH$_2$NHCO—, or —COS—, and BLOCK is directly linked to R—NH— through one of said thermally cleavable groups.

15. The photothermographic material of claim 14 wherein said thermally-releasable p-phenylenediamine co-developer is represented by the following Structures II:

(II)

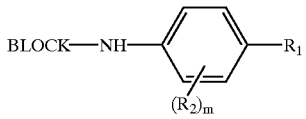

wherein $R_1$ is an amino group, $R_2$ is hydrogen, or a substituted or unsubstituted alkyl, alkenyl, alkoxy, thioalkyl, or halo group, m is 0, 1, or 2, and BLOCK is any of the following groups BLOCK-1 through BLOCK-8:

| | |
|---|---|
| BLOCK-1 | —CONH—$R_3$ (ureido group) |
| BLOCK-2 | —COO—$R_3$ (carbamoyl group) |
| BLOCK-3 | —CONHSO$_2$—$R_3$ |
| BLOCK-4 | 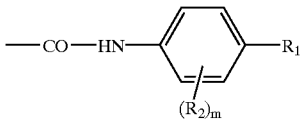 |
| BLOCK-5 | —SO$_2$—$R_3$ |
| BLOCK-6 | —PO—(OR$_3$)$_2$ (phosphate group) |
| BLOCK-7 | —COCH$_2$NHCO—$R_3$ |
| BLOCK-8 | —COS—$R_3$ |

wherein $R_3$ is substituted or unsubstituted alkyl, alkenyl, aryl, cycloalkyl, or heterocyclyl group.

16. The photothermographic material of claim 14 wherein said thermally-releasable p-phenylenediamine co-developer is one or more of the following compounds CD-1 through CD-15:

(CD-1)
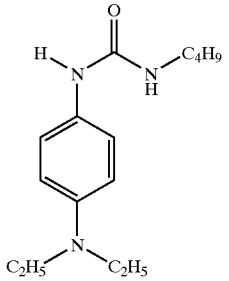
(CD-2)
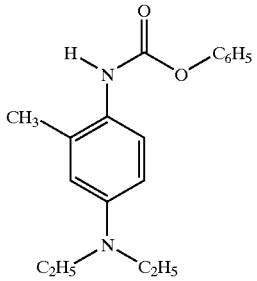
(CD-3)
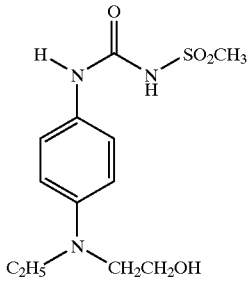
(CD-4)
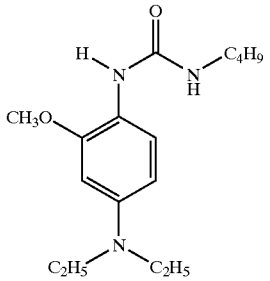
(CD-5)
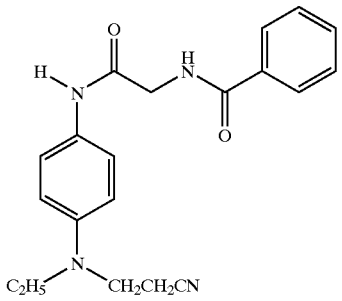
-continued
(CD-6)
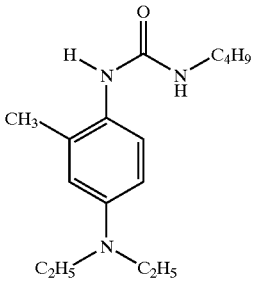
(CD-7)
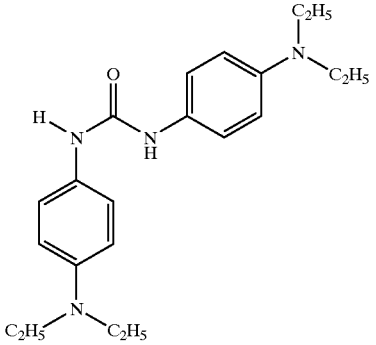
(CD-8)
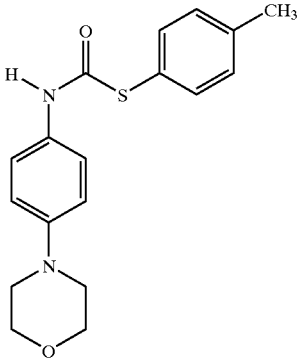
(CD-9)
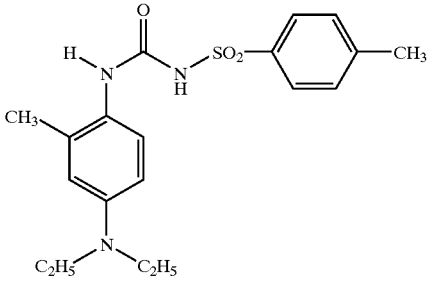
(CD-10)
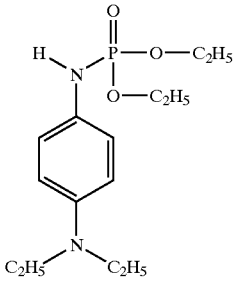

-continued (CD-11)

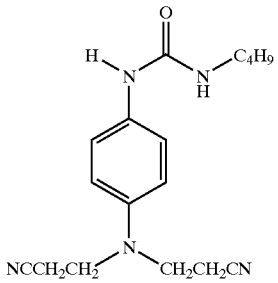

(CD-12)

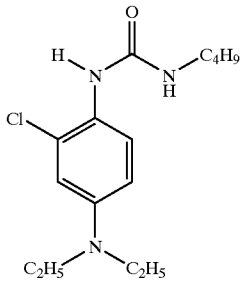

(CD-13)

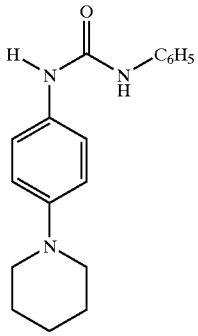

(CD-14)

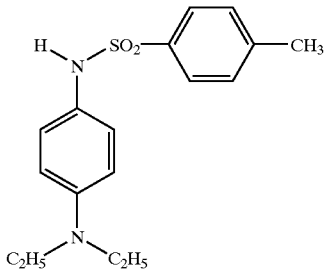

(CD-15)

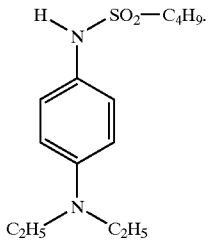

17. The photothermographic material of claim 14 wherein said hindered phenol reducing agent and said thermally-releasable p-phenylenediamine co-developer are present in the same imaging layer at a molar ratio of said hindered phenol reducing agent to said thermally-releasable p-phenylenediamine co-developer of at least 10:1, the amount of said hindered phenol reducing agent is at least 0.4 g/m$^2$, and the amount of said thermally-releasable p-phenylenediamine co-developer is at least 0.2 g/m$^2$.

18. A black-and-white photothermographic material that comprises a support having thereon:

a) one or more thermally developable imaging layers each comprising a hydrophobic binder, and in reactive association, a photosensitive silver bromide or silver iodobromide, a non-photosensitive source of reducible silver ions that includes one or more silver carboxylates at least one of which is silver behenate, a reducing composition for said non-photosensitive source of reducible silver ions that includes at least one bis-phenol reducing agent and a thermally-releasable p-phenylenediamine co-developer that is represented by the following Structure II:

(II)

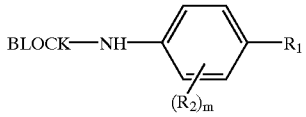

wherein $R_1$ is an amino group, $R_2$ is hydrogen, or a substituted or unsubstituted alkyl, alkenyl, alkoxy, thioalkyl, or halo group, m is 0, 1, or 2, and BLOCK is any of the following groups BLOCK-1 through BLOCK-8:

| | |
|---|---|
| BLOCK-1 | —CONH—$R_3$ (ureido group) |
| BLOCK-2 | —COO—$R_3$ (carbamoyl group) |
| BLOCK-3 | —CONHSO$_2$—$R_3$ |
| BLOCK-4 | 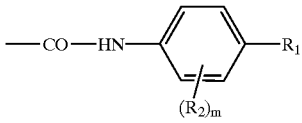 |
| BLOCK-5 | —SO$_2$—$R_3$ |
| BLOCK-6 | —PO—(OR$_3$)$_2$ (phosphate group) |
| BLOCK-7 | —COCH$_2$NHCO—$R_3$ |
| BLOCK-8 | —COS—$R_3$ |

wherein $R_3$ is an alkyl, alkenyl, aryl, cycloalkyl, or heterocyclyl group, wherein the molar ratio of said bis-phenol reducing agent to said thermally-releasable p-phenylenediamine co-developer is from about 5:1 to about 1:1, said bis-phenol reducing agent is present in an amount of from about 0.5 to about 1.5 g/m$^2$, and said thermally-releasable p-phenylenediamine co-developer is present in an amount of from about 0.25 to about 1.0 g/m$^2$, and b) a protective overcoat disposed over said one or more thermally-developable imaging layers, an antihalation layer on the backside, or both said protective layer and said antihalation layer.

19. A method of forming a black-and-white image comprising thermally forming and developing a black-and-white image in the thermally developable material of claim 1.

20. A method of forming a visible image comprising:

A) imagewise exposing the photothermographic material of claim 14 to electromagnetic radiation to form a latent image, B) simultaneously or sequentially, heating said exposed photothermographic material to develop said latent image into a visible image.

21. The method of claim 19 wherein said photothermographic material comprises a transparent support, and said image-forming method further comprises:

C) positioning said exposed and heat-developed photothermographic material with the visible image therein between a source of imaging radiation and an imageable material that is sensitive to said imaging radiation, and D) exposing said imageable material to said imaging radiation through the visible image in said exposed and heat-developed photothermographic material to provide an image in said imageable material.

22. An imaging assembly comprising a thermally developable material arranged in association with a phosphor intensifying screen, said thermally developable material comprising a support having thereon one or more thermally developable imaging layers comprising:

a binder, a photosensitive silver halide, a non-photosensitive source of reducible silver ions, and a reducing agent composition for said non-photosensitive source of reducible silver ions, said reducing agent composition comprising: a) a hindered phenol reducing agent, an aromatic di- or tri-hydroxy compound, or mixtures thereof, and b) a thermally-releasable p-phenylenediamine co-developer that is represented by the following Structure I:

R—NH-BLOCK (I)

wherein R—NH— is a p-phenylenediamine group and BLOCK is a blocking group that is cleaved upon exposure to at least 120° C. for at least 5 seconds and comprises one or more of the following thermally cleavable groups: —CONH—, —COO—, —$CONHSO_2$—, —$PO_3$—, —SO2—, —$COCH_2NHCO$—, or —COS—, and BLOCK is directly linked to R—NH— through one of said thermally cleavable groups.

* * * * *